US009343060B2

(12) United States Patent
Villavicencio

(10) Patent No.: US 9,343,060 B2
(45) Date of Patent: May 17, 2016

(54) VOICE PROCESSING USING CONVERSION FUNCTION BASED ON RESPECTIVE STATISTICS OF A FIRST AND A SECOND PROBABILITY DISTRIBUTION

(75) Inventor: Fernando Villavicencio, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 74 days.

(21) Appl. No.: 13/232,950

(22) Filed: Sep. 14, 2011

(65) Prior Publication Data

US 2012/0065978 A1 Mar. 15, 2012

(30) Foreign Application Priority Data

Sep. 15, 2010 (JP) ..... 2010-206562
Sep. 2, 2011 (JP) ..... 2011-191665

(51) Int. Cl.
*G10L 13/033* (2013.01)
*G10L 21/00* (2013.01)
*G10L 21/007* (2013.01)
(Continued)

(52) U.S. Cl.
CPC ..... *G10L 13/033* (2013.01); *G10L 21/003* (2013.01); *G10L 13/06* (2013.01); *G10L 21/007* (2013.01)

(58) Field of Classification Search
CPC ..... G10L 13/07; G10L 15/00; G10L 13/033; G10L 13/06; G10L 21/007; G10L 21/003
USPC ..... 704/230–260, 270, 278
See application file for complete search history.

(56) References Cited

U.S. PATENT DOCUMENTS 4,468,761 A * 8/1984 Rietsch ..... G01V 1/364 367/21
6,934,681 B1 * 8/2005 Emori ..... G10L 15/12 704/246

(Continued)

FOREIGN PATENT DOCUMENTS

JP 2003-066982 A 3/2003
JP 2005-266349 A 9/2005

OTHER PUBLICATIONS

Fernando Villavincencio, Axel Robel and Xavier Rodet, Applying Improved Spectral Modeling for High Quality Voice Conversion, 2009, IEEE, 978-1-4244-2354-5, p. 4285-4288.*

(Continued)

*Primary Examiner* — Pierre-Louis Desir
*Assistant Examiner* — Seong-Ah A. Shin
(74) *Attorney, Agent, or Firm* — Morrison & Foerster LLP

(57) ABSTRACT

In voice processing, a first distribution generation unit approximates a distribution of feature information representative of voice of a first speaker per a unit interval thereof as a mixed probability distribution which is a mixture of a plurality of first probability distributions corresponding to a plurality of different phones. A second distribution generation unit also approximates a distribution of feature information representative of voice of a second speaker as a mixed probability distribution which is a mixture of a plurality of second probability distributions. A function generation unit generates, for each phone, a conversion function for converting the feature information of voice of the first speaker to that of the second speaker based on respective statistics of the first and second probability distributions that correspond to the phone.

20 Claims, 9 Drawing Sheets

(51) Int. Cl.
*G10L 13/06* (2013.01)
*G10L 21/003* (2013.01)

(56) References Cited

U.S. PATENT DOCUMENTS

| | | | | |
|---|---|---|---|---|
| 6,992,245 | B2 * | 1/2006 | Kenmochi et al. | 84/622 |
| 7,181,402 | B2 * | 2/2007 | Jax et al. | 704/500 |
| 7,240,005 | B2 * | 7/2007 | Chihara | G10L 13/08 704/258 |
| 7,505,950 | B2 * | 3/2009 | Tian | G10L 13/033 704/208 |
| 7,580,839 | B2 * | 8/2009 | Tamura et al. | 704/258 |
| 7,765,101 | B2 * | 7/2010 | En-Najjary | G10L 13/033 704/206 |
| 7,792,672 | B2 * | 9/2010 | Rosec | G10L 21/00 704/208 |
| 8,010,362 | B2 * | 8/2011 | Tamura | G10L 21/00 704/265 |
| 8,099,282 | B2 * | 1/2012 | Masuda | G10L 13/033 704/231 |
| 8,131,550 | B2 * | 3/2012 | Nurminen | G10L 13/033 704/200 |
| 8,401,861 | B2 * | 3/2013 | Wei | G10L 15/07 704/254 |
| 2008/0292016 | A1 * | 11/2008 | Piechocki | H04L 1/005 375/260 |
| 2010/0049522 | A1 * | 2/2010 | Tamura | G10L 13/033 704/264 |
| 2012/0253794 | A1 * | 10/2012 | Chun | G10L 21/003 704/201 |

OTHER PUBLICATIONS

Yannis Stylianous, Olivier Cappe & Eric Moulines, Continuous Probabilistic Transform for Voice Conversion, 1988, IEEE Transactions on speech and audio processing, vol. 6, No. 2, 1063-6676/98, p. 131-142.*

Alexander Kain and Michael W. Macon, Spectral Voice Conversion for Text-to-Speech Synthesis, 1998, IEEE, 0-7803-4428-6-98, p. 285-288.*

Tomoki Toda, Hiroshi Saruwatari and Kiyohiro Shikano, Voice Conversion Algorithm Based on Gaussian Mixture Model with Dynamic Frequency Warping of Straight Spectrum, 2001, IEEE, 0-7803-7041-4/01, p. 841-844.*

Alexander Blouke Kain, High Resolution Voice Transformation, Oct. 2001, Oregon Health & Science University.*

Kain et al., "High Resolution Voice Tranformation", Oct. 2001, Oregon Health & Science University, p. 51-53.*

Villavicencio et al., "Applying Improved Spectral Modeling for High Quality Voice Conversion", 2009, IEEE, p. 4285-4288.*

Kain ("High Resolution Voice Transformation", a dissertation, Oregon Health & Science University, Oct. 2001).*

Miyamoto et al., "Acoustic compensation methods for body transmitted speech conversion," 2009, Acoustics, Speech and Signal Processing, IEEE.*

Villavincencio et al., "Applying Improved Spectral Modeling for High Quality Voice Conversion", IEEE, 2009.*

Chapter 4 Covariance Functions C. E. Rasmussen & C. K. I. Williams, Gaussian Processes for Machine Learning, the MIT Press, 2006, ISBN 026218253X. c 2006 Massachusetts Institute of Technology. www.GaussianProcess.org/gpml).*

Duxans, H. et al. (Oct. 4, 2004). "Including Dynamic and Phonetic Information in Voice Conversion Systems," International Conference on Spoken Language, Processing 2004, Jeju, Korea, Retrieved from Internet: URL:http:www.google.dejurl?sa=t&rct=j&q=&esrc=s &source=web&cd=1&cad=rja&ved=OCCQF jAA &url=http%3A%2F%2Fnlp.lsi.upc.edu%2Fpapers%2Fduxans04a. pdf&ei=g2woUpyOEMjOhAeF4oH YBg &usg=AFQjCNH8hYUTR9UpK-1hpr00Gjxd6Gt4RA&bvm=bv. 51773540,d.ZG4, five pages.

Villavicencio, F. et al. (Sep. 2010). "GMM-PCA Based Speaker-Timbre Conversion on Full-Quality Speech," *Speech Synthesis Workshop Japan 2010*, Spetember 22-24, 2010, six pages.

Villavicencio, F. et al. (Sep. 2010). "Resurrecting Past Singers: Non-Parallel Singing-Voice Conversion," *Inter Singing Conference*, Sptember 27-30, 2010, six pages.

Notice of Reason for Rejection issued Mar. 31, 2015, for Japanese Patent Application No. 2011-191665, with English translation, six pages.

Kain, A. et al. (May 1998). "Spectral Voice Conversion For Text-To-Speech Synthesis," *Proceedings of the International Conference on Acoustics, Speech, and Signal Processing*, 1:285-288.

Mouchtaris, A. et al. (May 2006). "Nonparallel Training for Voice Conversion Based on a Parameter Adaptation Approach," *IEEE Transactions on Audio, Speech, and Language Processing* 14(3):952-963.

Stylianou, Y. et al. (Mar. 1998). "Continuous Probabilistic Transform for Voice Conversion," *IEEE Transactions on Speech and Audio Processing* 6(2):131-142.

Villavicencio, F. et al. (Sep. 2010). "GMM-PCA Based Speaker-Timbre Conversion on Full-Quality Speech," *Speech Synthesis Workshop Japan 2010*, Sep. 22-24, 2010, six pages.

Villavicencio, F. et al. (Sep. 2010). "Resurrecting Past Singers: Non-Parallel Singing-Voice Conversion," *Inter Singing Conference*, Sep. 27-30, 2010, six pages.

Villavicencio, F. et al. (Oct. 2010). "Applying Voice Conversion on Concatenative Singing-Voice Synthesis," *Interspeech* 2010, Oct. 1-2, 2010, four pages.

Duxans, H. et al. (Oct. 4, 2004). "Including Dynamic and Phonetic Information in Voice Conversion Systems," International Conference on Spoken Language, Processing 2004, Jeju, Korea, Retrieved from Internet: URL:http:www.google.dejurl?sa=t&rct=j&q=&esrc=s &source=web&cd=1&cad=rja&ved=OCCw QF jAA &url=http%3A%2F%2Fnlp.Isi.upc.edu%2Fpapers%2Fduxans04a. pdf&ei=g2woUpyOEMjOhAeF4oHYBg &usg=AFQjCNH8hYUTR9UpK1hpr00Gjxd6Gt4RA&bvm=bv. 51773540,d.ZG4, five pages.

European Search Report mailed Sep. 19, 2013, for EP Application No. 11181174.1, seven pages.

Liu, K. et al. (Aug. 1, 2007). "High Quality Voice Conversion Through Phoneme-based Linear Mapping Functions with STRAIGHT for Mandarin," Fourth International Conference on IEEE Piscataway, NJ, USA, 4 pages.

* cited by examiner

VOICE PROCESSING USING CONVERSION FUNCTION BASED ON RESPECTIVE STATISTICS OF A FIRST AND A SECOND PROBABILITY DISTRIBUTION

BACKGROUND OF THE INVENTION

1. Technical Field of the Invention

The present invention relates to a technology for synthesizing voice.

2. Description of the Related Art

A voice synthesis technology of segment connection type has been suggested in which voice is synthesized by selectively combining a plurality of segment data items, each representing a voice segment (or voice element) (for example, see Patent Reference 1). Segment data of each voice segment is prepared by recording voice of a specific speaker and dividing the speech voice into voice segments and analyzing each voice segment.

[Patent Reference 1] Japanese Patent Application Publication No. 2003-255998

[Non-Patent Reference 1] Alexander Kain, Michael W. Macon, "Spectral Voice Conversion for Text-to-Speech Synthesis", Proceedings of the International Conference on Acoustics, Speech, and Signal Processing, vol. 1, p. 285-288, May 1998

In the technology of Patent Reference 1, there is a need to prepare segment data for all types (all species) of voice segments individually for each voice quality of synthesized sound (i.e., for each speaker). However, speaking all species of voice segments required for voice synthesis imposes a great physical and mental burden upon the speaker. In addition, there is a problem in that it is not possible to synthesize voice of an speaker whose voice cannot be previously recorded (for example, voice of an speaker who passed away) when available species of voice segments are insufficient (deficient) for the speaker.

SUMMARY OF THE INVENTION

In view of these circumstances, it is an object of the invention to synthesize voice of a speaker for which available species of voice segments are insufficient.

The invention employs the following means in order to achieve the object. Although, in the following description, elements of the embodiments described later corresponding to elements of the invention are referenced in parentheses for better understanding, such parenthetical reference is not intended to limit the scope of the invention to the embodiments.

A voice processing device of the invention comprises a first distribution generation unit (for example, a first distribution generator 342) that approximates a distribution of feature information (for example, feature information X) representative of voice of a first speaker per unit interval thereof as a mixed probability distribution (for example, a mixed distribution model $\lambda S(X)$) which is a mixture of a plurality of first probability distributions (for example, normalized distributions $NS_1$ to $NS_Q$) corresponding to a plurality of different phones, a second distribution generation unit (for example, a second distribution generator 344) that approximates a distribution of feature information (for example, feature information Y) representative of voice of a second speaker per a unit interval thereof as a mixed probability distribution (for example, a mixed distribution model $\lambda T(Y)$) which is a mixture of a plurality of second probability distributions (for example, normalized distributions $NT_1$ to $NT_Q$) corresponding to a plurality of different phones, and a function generation unit (for example, a function generator 36) that generates, for each phone, a conversion function (for example, conversion functions $F_1(X)$ to $F_Q(X)$) for converting the feature information (X) of voice of the first speaker to the feature information of voice of the second speaker based on respective statistics (statistic parameters $t\mu_q^X$, $\Sigma_q^{XX}$, $\mu_q^Y$ and $\Sigma_q^Y$) of the first probability distribution and the second probability distribution that correspond to the phone.

In this aspect, a first probability distribution which approximates a distribution of feature information of voice of a first speaker and a second probability distribution which approximates a distribution of feature information of voice of a second speaker are generated, and a conversion function for converting the feature information of voice of the first speaker to the feature information of voice of the second speaker is generated for each phone using a statistic of the first probability distribution and a statistic of the second probability distribution corresponding to each phone. The conversion function is generated based on the assumption of a correlation (for example, a linear relationship) between the feature information of voice of the first speaker and the feature information of voice of the second speaker. In this configuration, even when recorded voice of the second speaker does not include all species of phone chain (for example, diphone and triphone), it is possible to generate any voice segment of the second speaker by applying the conversion function of each phone to the feature information of a corresponding voice segment (specifically, a phone chain) of the first speaker. As understood from the above description, the present invention is especially effective in the case where the original voice previously recorded from the second speaker does not include all species of phone chain, but it is also practical to synthesize voice of the second speaker from the voice of the first speaker in similar manner even in the case where all species of the phone chain of the second speaker have been recorded.

Such discrimination between the first speaker and the second speaker means that characteristics of their spoken sounds (voices) are different (i.e., sounds spoken by the first and second speakers have different characteristics), no matter whether the first and second speakers are identical or different (i.e., the same or different individuals). The conversion function means a function that defines correlation between the feature information of voice of the first speaker and the feature information of voice of the second speaker (mapping from the feature information of voice of the first speaker to the feature information of voice of the second speaker). Respective statistics of the first probability distribution and the second probability distribution used to generate the conversion function can be selected appropriately according to elements of the conversion function. For example, an average and covariance of each probability distribution is preferably used as a statistic parameter for generating the conversion function.

A voice processing device according to a preferred aspect of the invention includes a feature acquisition unit (for example, a feature acquirer 32) that acquires, for voice of each of the first and second speakers, feature information including a plurality of coefficient values, each representing a frequency of a line spectrum that represents, by a frequency line density of the line spectrum, a height of each peak in an envelope of a frequency domain of the voice of each of the first and second speakers, wherein each of the first and second distribution generation unit generates a mixed probability distribution corresponding to feature information acquired by the feature acquisition unit. This aspect has an advantage in that it is possible to correctly represent an envelope of voice using a plurality of coefficient values, each representing a frequency of a line spectrum that represents, by a frequency line density of the line spectrum, a height of each peak in an envelope of voice of the segment data.

For example, the feature acquisition unit includes an envelope generation unit (for example, process S13) that generates an envelope through interpolation (for example, 3rd-order spline interpolation) between peaks of the frequency spectrum for voice of each of the first and second speakers and a feature specification unit (for example, processes S16 and S17) that estimates an autoregressive (AR) model approximating the envelope and sets a plurality of coefficient values according to the AR model. This aspect has an advantage in that feature information that correctly represents the envelope is generated, for example, even when the sampling frequency of voice of each of the first and second speakers is high since a plurality of coefficient values is set according to an autoregressive (AR) model approximating an envelope generated through interpolation between peaks of the frequency spectrum.

In a preferred aspect of the invention, the function generation unit generates a conversion function for a qth phone (q=1−Q) among Q phones in the form of an equation $\{\mu_q^Y+(\Sigma_q^{YY}(\Sigma_q^{XX})^{-1})^{1/2}(X-\mu_q^X\}$ using an average $\mu_q^X$ and a covariance $\Sigma_q^{XX}$ of the first probability distribution corresponding to the qth phone, an average $\mu_q^Y$ and a covariance $\Sigma_q^{YY}$ of the second probability distribution corresponding to the qth phone, and feature information X of voice of the first speaker. In this configuration, it is possible to appropriately generate a conversion function even when a temporal correspondence between the feature information of the first speaker and the feature information of the second speaker is indefinite since the covariance ($\Sigma_q^{YX}$) between the feature information of voice of the first speaker and the feature information of voice of the second speaker is unnecessary. This equation is derived per each phone upon the assumption of a linear relationship (Y=aX+b) between the feature information X of voice of the first speaker and the feature information Y of voice of the second speaker.

In a preferred aspect of the invention, the function generation unit generates a conversion function for a qth phone (q=1−Q) among Q phones in the form of an equation $\{\mu_q^Y+e(\Sigma_q^{YY}(\Sigma_q^{XX})_{-1})^{1/2}(X-\mu_q^X)\}$ using an average $\mu_q^X$ and a covariance $\Sigma_q^{XX}$ of the first probability distribution corresponding to the qth phone, an average $\mu_q^Y$ and a covariance $\Sigma_q^{YY}$ of the second probability distribution corresponding to the qth phone, feature information X of voice of the first speaker, and an adjusting coefficient e(0<e<1). In this configuration, it is possible to appropriately generate a conversion function even when a temporal correspondence between the feature information of the first speaker and the feature information of the second speaker is indefinite since the covariance ($\Sigma_q^{YX}$) between the feature information of voice of the first speaker and the feature information of voice of the second speaker is unnecessary. Further, since $(\Sigma_q^{YY}(\Sigma_q^{XX})^{-1})^{1/2}$ is adjusted by the adjusting coefficient e, there is an advantage that the conversion function is generated for synthesizing the voice having high quality for the second speaker. This equation is derived per each phone upon the assumption of a linear relationship (Y=aX+b) between the feature information X of voice of the first speaker and the feature information Y of voice of the second speaker. The adjusting coefficient e is set to a value in a range from 0.5 to 0.7, and is set preferably at 0.6.

The voice processing device according to a preferred aspect of the invention further includes a storage unit (for example, a storage device 14) that stores first segment data (for example, segment data DS) for each of voice segments representing voice of the first speaker, each voice segment comprising one or more phones, and a voice quality conversion unit (for example, a voice quality converter 24) that sequentially generates second segment data (for example, segment data DT) for each voice segment of the second speaker based on second feature information obtained by applying a conversion function to first feature information of the first segment data. In detail, the second feature information is obtained by applying a conversion function corresponding to a phone contained in the voice segment DT, to the feature information of the voice segment DS represented by first segment data. In this aspect, second segment data corresponding to voice that is produced by speaking (vocalizing) a voice segment of the first segment data with a voice quality similar to (ideally, identical to) that of the second speaker is generated. Here, it is possible to employ a configuration in which the voice quality conversion unit previously creates second segment data of each voice segment before voice synthesis is performed or a configuration in which the voice quality conversion unit creates second segment data required for voice synthesis sequentially (in real time) in parallel with voice synthesis.

In a preferred aspect of the invention, when the first segment data includes a first phone (for example, a phone ρ1) and a second phone (for example, a phone ρ2), the voice quality conversion unit applies an interpolated conversion function to feature information of each unit interval within a transition period (for example, a transition period TIP) including a boundary (for example, a boundary B) between the first phone and the second phone such that the conversion function changes in a stepwise manner from a conversion function (for example, a conversion function $F_{q1}(X)$) of the first phone to a conversion function (for example, a conversion function $F_{q2}(X)$) of the second phone within the transition period. This aspect has an advantage in that it is possible to generate a synthesized sound that sounds natural, in which characteristics (for example, envelopes of frequency spectrums) of adjacent phones are smoothly continuous, from the first phone to the second phone, since the conversion function of the first phone and the conversion function of the second phone are interpolated such that an interpolated conversion function applied to feature information near the phone boundary of the first segment data changes in a stepwise manner within the transition period. A detailed example of this aspect will be described, for example, as a second embodiment.

In a preferred aspect of the invention, the voice quality conversion unit comprises a feature acquisition unit (for example, a feature acquirer 42) that acquires feature information including a plurality of coefficient values, each representing a frequency of a line spectrum that represents, by a frequency line density of the line spectrum, a height of each peak in an envelope of a frequency domain of voice represented by each first segment data, a conversion processing unit (for example, a conversion processor 44) that applies the conversion function to the feature information acquired by the feature acquisition unit, and a segment data generation unit (for example, a segment data generator 46) that generates second segment data corresponding to the feature information produced through conversion by the conversion processing unit. This aspect has an advantage in that it is possible to correctly represent an envelope of voice using a plurality of coefficient values, each representing a frequency of a line spectrum that represents, by a frequency line density of the line spectrum, a height of each peak in the envelope of voice of the first segment data.

The voice quality conversion unit in the voice processing device according to a preferred example of this aspect includes a coefficient correction unit (for example, a coefficient corrector 48) that corrects each coefficient value of the feature information produced through conversion by the conversion processing unit, and the segment data generation unit generates the segment data corresponding to the feature information produced through correction by the coefficient correction unit. In this aspect, it is possible to generate a synthesized sound that sounds natural by correcting each coefficient value, for example, such that the influence of conversion by the conversion function (for example, a reduction in the variance of each coefficient value) is reduced since the coefficient correction unit corrects each coefficient value of the feature information produced through conversion using the conversion function. A detailed example of this aspect will be described, for example, as a third embodiment.

The coefficient correction unit in a preferred aspect of the invention includes a first correction unit (for example, a first corrector 481) that changes a coefficient value outside a predetermined range to a coefficient value within the predetermined range. The coefficient correction unit also includes a second correction unit (for example, a second corrector 482) that corrects each coefficient value so as to increase a difference between coefficient values corresponding to adjacent spectral lines when the difference is less than a predetermined value. This aspect has an advantage in that excessive peaks are suppressed in an envelope represented by feature information since the difference between adjacent coefficient values is increased through correction by the second correction unit when the difference is excessively small.

The coefficient correction unit in a preferred aspect of the invention includes a third correction unit (for example, a third corrector 483) that corrects each coefficient value so as to increase variance of a time series of the coefficient value of each order. In this aspect, it is possible to generate a peak at an appropriate level in an envelope represented by feature information since variance of the coefficient value of each order is increased through correction by the third correction unit.

The voice processing device according to each of the aspects may not only be implemented by dedicated electronic circuitry such as a Digital Signal Processor (DSP) but may also be implemented through cooperation of a general arithmetic processing unit such as a Central Processing Unit (CPU) with a program. The program which allows a computer to function as each element (each unit) of the voice processing device of the invention may be provided to a user through a computer readable recording medium storing the program and then installed on a computer, and may also be provided from a server device to a user through distribution over a communication network and then installed on a computer.

DETAILED DESCRIPTION OF THE INVENTION

A: First Embodiment

Figure 1:
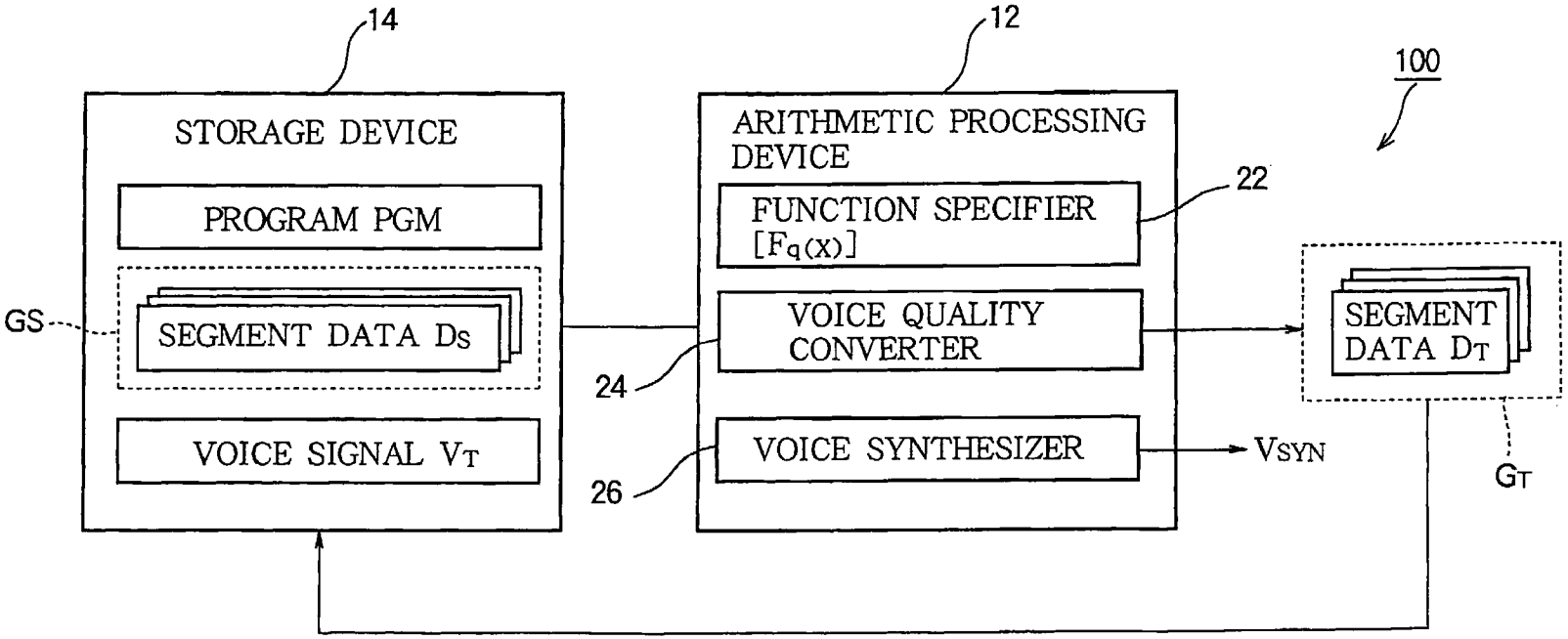
FIG. 1 is a block diagram of a voice processing device of a first embodiment of the invention.

FIG. 1 is a block diagram of a voice processing device 100 according to a first embodiment of the invention. As shown in FIG. 1, the voice processing device 100 is implemented as a computer system including an arithmetic processing device 12 and a storage device 14.

The storage device 14 stores a program PGM that is executed by the arithmetic processing device 12 and a variety of data (such as a segment group GS and a sound signal VT) that is used by the arithmetic processing device 12. A known recording medium such as a semiconductor storage device or a magnetic storage medium or a combination of a plurality of types of recording media is arbitrarily used as the storage device 14.

The segment group GS is a set of a plurality of segment data items DS corresponding to different voice segments (i.e., a sound synthesis library used for sound synthesis). Each segment data item DS of the segment group GS is time-series data representing a feature of a voice waveform of an speaker US (S: source). Each voice segment is a phone (i.e., a monophone), which is the minimum unit (for example, a vowel or a consonant) that is distinguishable in linguistic meaning, or a phone chain (such as diphone or triphone) which is a series of connected phones. Audibly natural sound synthesis is achieved using the segment data DS including a phone chain in addition to a single phone. The segment data DS is prepared for all types (all species) of voice segments required for speech synthesis (for example, for about 500 types of voice segments when Japanese voice is synthesized and for about 2000 types of voice segments when English voice is synthesized). In the following description, when the number of types of single phones among the voice segments is Q, each of a plurality of segment data items DS corresponding to the Q types of phones among the plurality of segment data items DS included in the segment group GS may be referred to as "phone data PS" or a "phone data item PS" for discrimination from segment data DS of a phone chain.

The voice signal VT is time-series data representing a time waveform of voice of an speaker UT (T: target) having a different voice quality from the source speaker US. The voice signal VT includes waveforms of all types (Q types) of phones (monophones). However, the voice signal VT normally does not include all types of phone chains (such as diphones and triphones) since the voice of the target voice signal VT is not a voice generated for the sake of speech synthesis (i.e., for the sake of segment data extraction). Accordingly, the same number of segment data items as the segment data items DS of the segment group GS cannot be directly extracted from the voice signal VT alone. The segment data DS and segment data DT can be generated not only from voices generated by different speakers but also from voices with different voice qualities generated by one speaker. That is, the source speaker US and the target speaker UT may be the same person.

Each of the segment data DS and the voice signal VT of this embodiment includes a sequence of numerical values obtained by sampling a temporal waveform of voice at a predetermined sampling frequency Fs. The sampling frequency Fs used to generate the segment data DS or the voice signal VT is set to a high frequency (for example, 44.1 kHz equal to the sampling frequency for general music CD) in order to achieve high quality speech synthesis.

The arithmetic processing device 12 of FIG. 1 implements a plurality of functions (such as a function specifier 22, a voice quality converter 24, and a voice synthesizer 26) by executing the program PGM stored in the storage device 14. The function specifier 22 specifies conversion functions $F_1(X)$–$F_Q(X)$ respectively for Q types of phones using the segment group GS of the first speaker US (the segment data DS) and the voice signal VT of the second speaker UT. The conversion function $F_q(X)$ (q=1–Q) is a mapping function for converting voice having a voice quality of the first speaker US into voice having a voice quality of the second speaker UT.

The voice quality converter 24 of FIG. 1 generates the same number of segment data items DT as the segment data items DS (i.e., a number of segment data items DT corresponding to all types of voice segments required for voice synthesis) by applying the conversion functions $F_q(x)$ generated by the function specifier 22 respectively to the segment data items DS of the segment group GS. Each of the segment data items DT is time-series data representing a feature of a voice waveform that approximates (ideally, matches) the voice quality of the speaker UT. A set of segment data items DT generated by the voice quality converter 24 is stored as a segment group GT (as a library for speech synthesis) in the storage device 14.

The voice synthesizer 26 synthesizes a voice signal VSYN representing voice of the source speaker US corresponding to each segment data item DS in the storage device 14 or a voice signal VSYN representing voice of the target speaker UT corresponding to each segment data item DT generated by the voice quality converter 24. The following are descriptions of detailed configurations and operations of the function specifier 22, the voice quality converter 24, and the voice synthesizer 26.

<Function Specifier 22>

Figure 2:
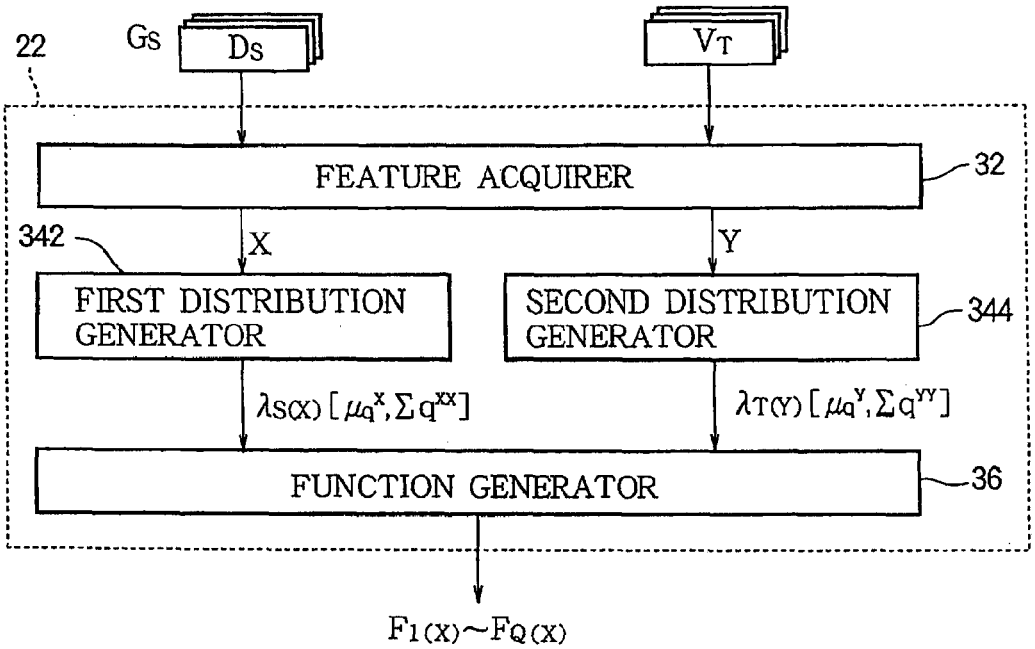
FIG. 2 is a block diagram of a function specifier.
Figure 3:
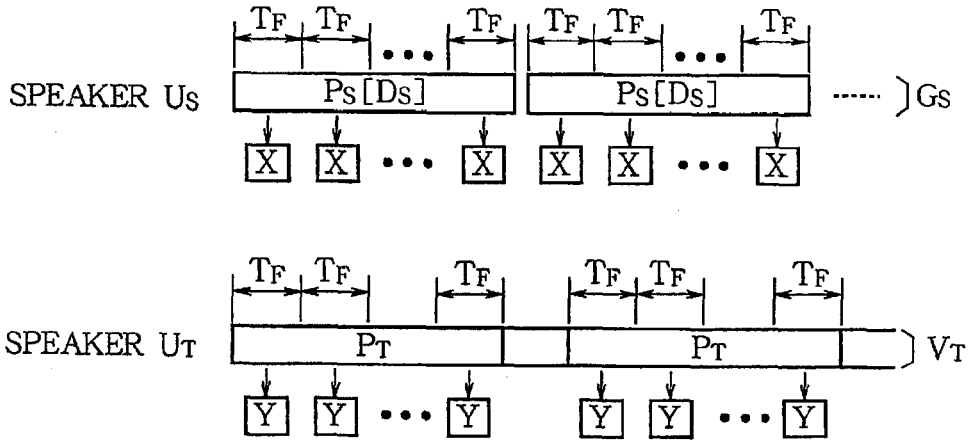
FIG. 3 illustrates an operation for acquiring feature information.

FIG. 2 is a block diagram of the function specifier 22. As shown in FIG. 2, the function specifier 22 includes a feature acquirer 32, a first distribution generator 342, a second distribution generator 344, and a function generator 36. As shown in FIG. 3, the feature acquirer 32 generates feature information X per each unit interval TF of a phone (i.e., phone data PS) spoken (vocalized) by the speaker US and feature information Y per each unit interval TF of a phone (i.e., voice signal VT) spoken by the speaker UT. First, the feature acquirer 32 generates feature information X in each unit interval TF (each frame) for each of phone data items PS corresponding to Q phones (monophones) among a plurality of segment data items DS of the segment group GS. Second, the feature acquirer 32 divides the voice signal VT into phones on the time axis and extracts time-series data items representing respective waveforms of the phones (hereinafter referred to as "phone data items PT") and generates feature information Y per each unit interval TF for each phone data item PT. A known technology is arbitrarily employed for the process of dividing the voice signal VT into phones. It is also possible to employ a configuration in which the feature acquirer 32 generates feature information X per each unit interval TF from a voice signal of the speaker US that is stored separately from the segment data DS.

Figure 4:
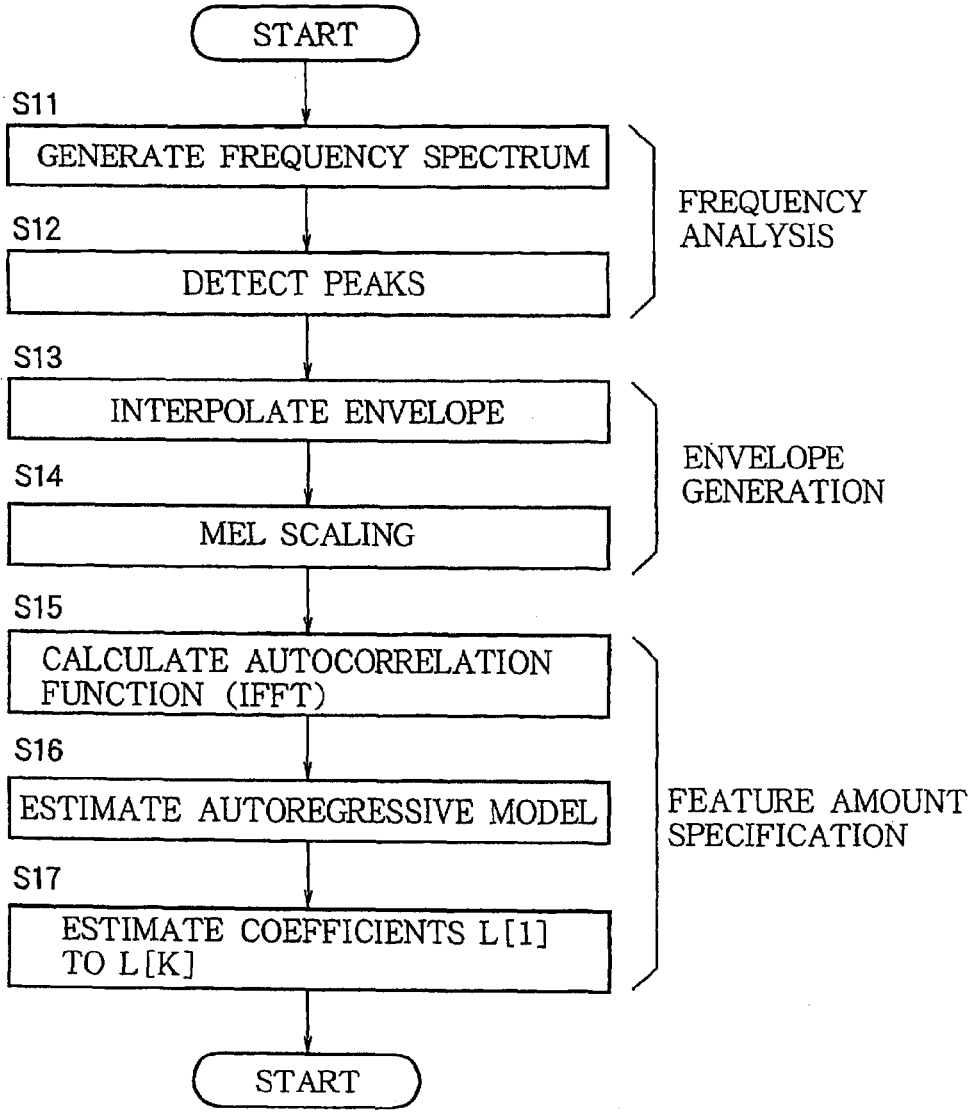
FIG. 4 illustrates an operation of a feature acquirer.

FIG. 4 illustrates an operation of the feature acquirer 32. In the following description, it is assumed that feature information X is generated from each phone data item PS of the segment group GS. As shown in FIG. 4, the feature acquirer 32 generates feature information X by sequentially performing frequency analysis (S11 and S12), envelope generation (S13 and S14), and feature quantity specification (S15 to S17) for each unit interval TF of each phone data item PS.

When the procedure of FIG. 4 is initiated, the feature acquirer 32 calculates a frequency spectrum SP through frequency analysis (for example, short time Fourier transform) of each unit interval TF of the phone data PS (S11). The time length or position of each unit interval TF is variably set according to a fundamental frequency of voice represented by the phone data PS (pitch synchronization analysis). As shown by a dashed line in FIG. 5, a plurality of peaks corresponding to (fundamental and harmonic) components is present in the frequency spectrum SP calculated in process S11. The feature acquirer 32 detects the plurality of peaks of the frequency spectrum SP (S12).

Figure 5:
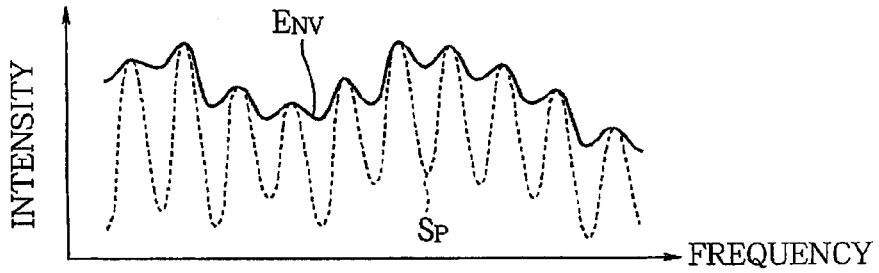
FIG. 5 illustrates an (interpolation) process for generating an envelope.

As shown by a solid line in FIG. 5, the feature acquirer 32 specifies an envelope ENV by interpolating between each peak (each component) detected in process S12 (S13). Known curve interpolation technology such as, for example, cubic spline interpolation is preferably used for the interpolation of process S13. The feature acquirer 32 emphasizes low frequency components by converting (i.e., Mel scaling) frequencies of the envelope ENV generated through interpolation into Mel frequencies (S14). The process S14 may be omitted.

The feature acquirer 32 calculates an autocorrelation function by performing Inverse Fourier transform on the envelope ENV after process S14 (S15) and estimates an autoregressive (AR) model (an all-pole transfer function) that approximates the envelope ENV from the autocorrelation function of process S15 (S16). For example, the Yule-Walker equation is preferably used to estimate the AR model in process S16. The feature acquirer 32 generates, as feature information X, a K-dimensional vector whose elements are K coefficient values (line spectral frequencies) L[1] to L[K] obtained by converting coefficients (AR coefficients) of the AR model estimated in process S16 (S17).

The coefficient values L[1] to L[K] correspond to K Line Spectral Frequencies (LSFs) of the AR model. That is, coefficient values L[1] to L[K] corresponding to the spectral lines are set such that intervals between adjacent spectral lines (i.e., densities of the spectral lines) are changed according to levels of the peaks of the envelope ENV approximated by the AR model of process 16. Specifically, a smaller difference between coefficient values L[k−1] and L[k] that are adjacent on the (Mel) frequency axis (i.e., a smaller interval between adjacent spectral lines) indicates a higher peak in the envelope ENV. In addition, the order K of the AR model estimated in process S16 is set according to the minimum value F0min of the fundamental frequency of each of the voice signal VT and the segment data DS and the sampling frequency Fs. Specifically, the order K is set to a maximum value (for example, K=50-70) in a range below a predetermined value (Fs/(2·F0min)).

The feature acquirer 32 repeats the above procedure (S11 to S17) to generate feature information X for each unit interval TF of each phone data item PS. The feature acquirer 32 performs frequency analysis (S11 and S12), envelope generation (S13 and S14), and feature quantity specification (S15 to S17) for each unit interval TF of a phone data item PT extracted for each phone from the voice signal VT in the same manner as described above. Accordingly, the feature acquirer 32 generates, as feature information Y, a K-dimensional vector whose elements are K coefficient values L[1] to L[K] for each unit interval TF. The feature information Y (coefficient values L[1] to L[K]) represents an envelope of a frequency spectrum SP of voice of the speaker UT represented by each phone data item PT.

Known Linear Prediction Coding (LPC) may also be employed to represent the envelope ENV. However, if the order of analysis is set to a high value according to LPC, there is a tendency to estimate an envelope ENV which excessively emphasizes each peak (i.e., an envelope which is significantly different from reality) when the sampling frequency Fs of an analysis subject (the segment data DS and voice signal VT) is high. On the other hand, in this embodiment in which the envelope ENV is approximated through peak interpolation (S13) and AR model estimation (S16) as described above, there is an advantage in that it is possible to correctly represent the envelope ENV even when the sampling frequency Fs of an analysis subject is high (for example, the same sampling frequency of 44.1 kHz as described above).

The first distribution generator 342 of FIG. 2 estimates a mixed distribution model λS(X) that approximates a distribution of the feature information X acquired by the feature acquirer 32. The mixed distribution model λS(X) of this embodiment is a Gaussian Mixture Model (GMM) defined in the following Equation (1). Since a plurality of feature information X sharing a phone is present unevenly at a specific position in the space, the mixed distribution model λS(X) is expressed as a weighted sum (linear combination) of Q normalized distributions $NS_1$ to $NS_Q$ corresponding to different phones. The mixed distribution model λS(X) means a model defined by a plurality of normal distributions, and is therefore called Multi Gaussian Model: MGM.

$$\lambda_S(X) = \sum_{q=1}^{Q} \omega_q^X NS_q\left(X; \mu_q^X, \sum_q^{XX}\right) \quad (1)$$

$$\left(\sum_{q=1}^{Q} \omega_q^X = 1, \omega_q^X \geq 0\right)$$

A symbol $\omega_q^X$ in Equation (1) denotes a weight of the qth normalized distribution $NS_q$ (q=1–Q). In addition, a symbol $\mu_q^X$ in Equation (1) denotes an average (average vector) of the normalized distribution $NS_q$ and a symbol $\Sigma_q^{XX}$ denotes a covariance (auto-covariance) of the normalized distribution $NS_q$. The first distribution generator 342 calculates statistic variables (weights $\omega_1^X$–$\omega_Q^X$, averages $\mu_1^X$–$\mu_Q^X$, and covariances $\Sigma_1^{XX}$–$\Sigma_Q^{XX}$) of each normalized distribution $NS_q$ of the mixed distribution model λS(X) of Equation (1) by performing an iterative maximum likelihood algorithm such as an Expectation-Maximization (EM) algorithm.

Similar to the first distribution generator 342, the second distribution generator 344 of FIG. 2 estimates a mixed distribution model λT(Y) that approximates a distribution of the feature information Y acquired by the feature acquirer 32. Similar to the mixed distribution model λS(X) described above, the mixed distribution model λT(Y) is a normalized mixed distribution model (GMM) of Equation (2) expressed as a weighted sum (linear combination) of Q normalized distributions $NT_1$ to $NT_Q$ corresponding to different phones.

$$\lambda_T(Y) = \sum_{q=1}^{Q} \omega_q^Y NT_q\left(Y; \mu_q^Y, \sum_q^{YY}\right) \quad (2)$$

$$\left(\sum_{q=1}^{Q} \omega_q^Y = 1, \omega_q^Y \geq 0\right)$$

A symbol $\omega_q^Y$ in Equation (2) denotes a weight of the qth normalized distribution $NT_q$. In addition, a symbol $\mu_q^Y$ in Equation (2) denotes an average of the normalized distribution $NT_q$ and a symbol $\Sigma_q^{YY}$ denotes a covariance (auto-covariance) of the normalized distribution $NT_q$. The second distribution generator 344 calculates these statistic variables (weights $\omega_1^Y$–$\omega_Q^Y$, averages $\mu_1^Y$–$\mu_Q^Y$, and covariances $\Sigma_1^{YY}$–$\Sigma_Q^{YY}$) of the mixed distribution model λT(Y) of Equation (2) by performing a known iterative maximum likelihood algorithm.

The function generator 36 of FIG. 2 generates a conversion function $F_q(X)$ ($F_1(X)$–$F_Q(X)$) for converting voice of the speaker US to voice having a voice quality of the speaker UT using the mixed distribution model λS(X) (the average $\mu_q^X$ and the covariance $\Sigma_q^{XX}$) and the mixed distribution model λT(Y) (the average $\mu_q^Y$ and the covariance $\Sigma_1^{YY}$). The conversion function F(X) of the following Equation (3) is described in Non-Patent Reference 1.

$$F(X) = \sum_{q=1}^{Q}\left(\mu_q^Y + \sum_q^{YX}\left(\sum_q^{XX}\right)^{-1}(X - \mu_q^X)\right)\cdot p(c_q \mid X) \quad (3)$$

A probability term p ($c_q$|X) in Equation (3) denotes a probability (conditional probability) belonging to the qth normal distribution $NS_q$ among the Q normal distributions $NS_1$–$NS_Q$ and is expressed, for example, by the following Equation (3A).

$$p(c_q \mid X) = \frac{NS_q\left(X; \mu_q^X, \sum_q^{XX}\right)}{\sum_{p=1}^{Q} NS_p\left(X; \mu_p^X, \sum_p^{XX}\right)} \quad (3A)$$

A conversion function $F_q(X)$ of the following Equation (4) corresponding to the qth phone is derived from a part of Equation (3) corresponding to the qth normalized distribution ($NS_q$, $NT_q$).

$$F_q(X)=\{\mu_q^Y+\Sigma_q^{YX}(\Sigma_q^{XX})^{-1}(X-\mu_q^X)\}\cdot p(c_q|X) \quad (4)$$

A symbol $\Sigma_q^{YX}$ in Equation (3) and Equation (4) is a covariance between the feature information X and the feature information Y. Calculation of the covariance $\Sigma_q^{YX}$ from a number of combination vectors including the feature information X and the feature information Y which correspond to each other on the time axis is described in Non-Patent Reference 1. However, temporal correspondence between the feature information X and the feature information Y is indefinite in this embodiment. Therefore, let us assume that a linear relationship of the following Equation (5) is satisfied between feature information X and feature information Y corresponding to the qth phone.

$$Y=a_qX+b_q \quad (5)$$

Based on the relation of Equation (5), a relation of the following Equation (6) is satisfied for the average $\mu_q^X$ of the feature information X and the average $\mu_q^Y$ of the feature information Y.

$$\mu_q^Y = a_q \mu_q^X + b_q \tag{6}$$

The covariance $\Sigma_q^{YX}$ of Equation (4) is modified to the following Equation (7) using Equations (5) and (6). Here, a symbol E[ ] denotes an average over a plurality of unit intervals TF.

$$\begin{aligned}\sum_q^{YX} &= E[(Y-\mu_q^Y)(X-\mu_q^X)] \\ &= E[\{(a_qX+b_q)-(a_q\mu_q^X+b_q)\}(X-\mu_q^X)] \\ &= a_qE[(X-\mu_q^X)^2] \\ &= a_q\sum_q^{XX}\end{aligned} \tag{7}$$

Accordingly, Equation (4) is modified to the following Equation (4A).

$$F_q(X)=\{\mu_q^Y+a_q(X-\mu_q^X)\}\cdot p(c_q|X) \tag{4A}$$

On the other hand, the covariance $\Sigma_q^{YY}$ of the feature information Y is expressed as the following Equation (8) using the relations of Equations (5) and (6).

$$\begin{aligned}\sum_q^{YY} &= E[(Y-\mu_q^Y)^2] \\ &= E[\{(a_qX+b_q)-(a_q\mu_q^X+b_q)\}^2] \\ &= E[a_q^2(X-\mu_q^X)] \\ &= a_q^2\sum_q^{XX}\end{aligned} \tag{8}$$

Thus, the following Equation (9) defining a coefficient $a_q$ of Equation (4A) is derived.

$$a_q=\sqrt{\Sigma_q^{YY}(\Sigma_q^{XX})^{-1}} \tag{9}$$

The function generator 36 of FIG. 2 generates a conversion function $F_q(X)$ ($F_1(X)$–$F_Q(X)$) of each phone by applying an average $\mu_q^X$ and a covariance $\Sigma_q^{XX}$ (i.e., statistics associated with the mixed distribution model λS(X)) calculated by the first distribution generator 342 and an average $\mu_q^Y$ and a covariance $\Sigma_q^{YY}$ (i.e., statistics associated with the mixed distribution model λT(Y)) calculated by the second distribution generator 344 to Equations (4A) and (9). The voice signal VT may be removed from the storage device 14 after the conversion function $F_q(X)$ is generated as described above.

<Voice Quality Converter 24>

Figure 6:
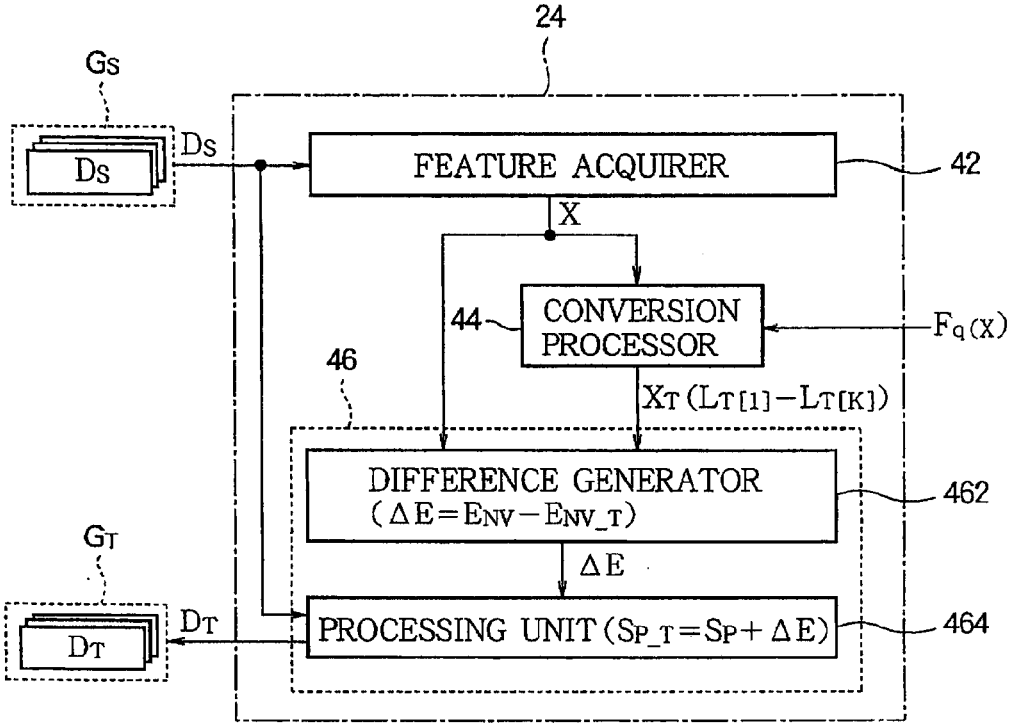
FIG. 6 is a block diagram of a voice quality converter.

The voice quality converter 24 of FIG. 1 generates a segment group GT by repeatedly performing, on each segment data item DS in the segment group GS, a process for applying each conversion function $F_q(X)$ generated by the function specifier 22 to the segment data item DS and generating a segment data item DT. Voice of the segment data DT generated from the segment data DS of each voice segment corresponds to voice generated by speaking the voice segment with a voice quality that is similar to (ideally, matches) the voice quality of the speaker UT. FIG. 6 is a block diagram of the voice quality converter 24. As shown in FIG. 6, the voice quality converter 24 includes a feature acquirer 42, a conversion processor 44, and a segment data generator 46.

The feature acquirer 42 generates feature information X for each unit interval TF of each segment data item DS in the segment group GS. The feature information X generated by the feature acquirer 42 is similar to the feature information X generated by the feature acquirer 32 described above. That is, similar to the feature acquirer 32 of the function specifier 22, the feature acquirer 42 generates feature information X for each unit interval TF of the segment data DS by performing the procedure of FIG. 4. Accordingly, the feature information X generated by the feature acquirer 42 is a K-dimensional vector whose elements are K coefficient values (line spectral frequencies) L[1] to L[K] representing coefficients (AR coefficients) of the AR model that approximates the envelope ENV of the frequency spectrum SP of the segment data DS.

The conversion processor 44 of FIG. 6 generates feature information XT for each unit interval TF by performing calculation of the conversion function $F_q(X)$ of Equation (4A) on the feature information X of each unit interval TF generated by the feature acquirer 42. A single conversion function $F_q(X)$ corresponding to one kind of phone of the unit interval TF among the Q conversion functions $F_1(X)$ to $F_Q(X)$ is applied to the feature information X of each unit interval TF. Accordingly, a common conversion function $F_q(X)$ is applied to the feature information X of each unit interval TF for segment data DS of a voice segment including a singe phone. On the other hand, a different conversion function $F_q(X)$ is applied to feature information X of each unit interval TF for segment data DS of a voice segment (phone chain) including a plurality of phones. For example, for segment data DS of a phone chain (i.e., a diphone) including a first phone and a second phone, a conversion function $F_{q1}(X)$ is applied to feature information X of each unit interval TF corresponding to the first phone and a conversion function $F_{q2}(X)$ is applied to feature information X of each unit interval TF corresponding to the second phone (q1≠q2). Similar to the feature information X before conversion, the feature information XT generated by the conversion processor 44 is a K-dimensional vector whose elements are K coefficient values (line spectral frequencies) LT[1] to LT[K] and represents an envelope ENV_T of a frequency spectrum of voice (i.e., voice that the speaker UT generates by speaking (or vocalizing) the voice segment of the segment data DS) generated by converting voice quality of voice of the speaker US represented by the segment data DS into voice quality of the speaker UT.

The segment data generator 46 sequentially generates segment data DT corresponding to the feature information XT of each unit interval TF generated by the conversion processor 44. As shown in FIG. 6, the segment data generator 46 includes a difference generator 462 and a processing unit 464. The difference generator 462 generates a difference ΔE (ΔE=ENV−ENV_T) between the envelope ENV represented by the feature information X that the feature acquirer 42 generates from the segment data DS and the envelope ENV_T represented by the feature information XT generated through conversion by the conversion processor 44. That is, the difference ΔE corresponds to a voice quality (frequency spectral envelope) difference between the speaker US and the speaker UT.

The processing unit 464 generates a frequency spectrum SP_T (SP_T=SP+ΔE) by synthesizing (for example, adding) the frequency spectrum SP of the segment data DS and the ΔE generated by the difference generator 462. As is understood from the above description, the frequency spectrum SP_T corresponds to a frequency spectrum of voice that the speaker UT generates by speaking a voice segment represented by the segment data DS. The processing unit 464 converts the frequency spectrum SP_T produced through synthesis into segment data DT of the time domain through inverse Fourier transform. The above procedure is performed on each segment data item DS (each voice segment) to generate a segment group GT.

<Voice Synthesizer 26>

Figure 7:
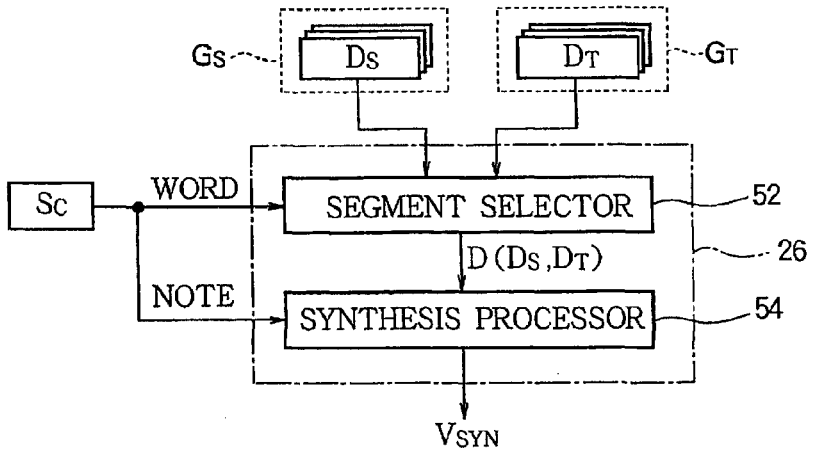
FIG. 7 is a block diagram of a voice synthesizer.

FIG. 7 is a block diagram of the voice synthesizer 26. Score data SC in FIG. 7 is information that chronologically specifies a note (pitch and duration) and a word (sound generation word) of each specified sound to be synthesized. The score data SC is composed according to an instruction (for example, an instruction to add or edit each specified sound) from the user and is then stored in the storage device 14. As shown in FIG. 7, the voice synthesizer 26 includes a segment selector 52 and a synthesis processor 54.

The segment selector 52 sequentially selects segment data D (DS, DT) of a voice segment corresponding to a song word (vocal) specified by the score data SC from the storage device 14. The user specifies one of the speaker US (segment group GS) and the speaker UT (segment group GT) to instruct voice synthesis. When the user has specified the speaker US, the segment selector 52 selects the segment data DS from the segment group GS. On the other hand, when the user has specified the speaker UT, the segment selector 52 selects the segment data DT from the segment group GT generated by the voice quality converter 24.

The synthesis processor 54 generates a voice signal VSYN by connecting the segment data items D (DS, DT) sequentially selected by the segment selector 52 after adjusting the segment data items D according to the pitch and duration of each specified note of the score data SC. The voice signal VSYN generated by the voice synthesizer 26 is provided to, for example, a sound emission device such as a speaker to be reproduced as a sound wave. As a result, a singing sound (or a vocal sound) that the speaker (US, UT) specified by the user generates by speaking the word of each specified sound of the score data SC is reproduced.

In the above embodiment, under the assumption of the linear relation (Equation (5)) between the feature information X and the feature information Y, a conversion function $F_q(X)$ of each phone is generated using both the average $\mu_q^X$ and covariance $\Sigma_q^{XX}$ of each normalized distribution $NS_q$ that approximates the distribution of the feature information X of voice of the speaker US and the average $\mu_q^Y$ and covariance $\Sigma_q^{YY}$ of each normalized distribution $NT_q$ that approximates the distribution of the feature information Y of voice of the speaker UT. In addition, segment data DT (a segment group GT) is generated by applying a conversion function $F_q(X)$ corresponding to a phone of each voice segment to the segment data DS of the voice segment. In this configuration, the same number of segment data items DT as the number of segment data items of the segment group GS are generated even when all types of voice segments for the speaker UT are not present. Accordingly, it is possible to reduce burden imposed upon the speaker UT. In addition, there is an advantage in that, even in a situation where voice of the speaker UT cannot be recorded (for example, where the speaker UT is not alive), it is possible to generate segment data DT corresponding to all types of voice segments (i.e., to synthesize an arbitrary voiced sound of the speaker UT) if only the voice signal VT of each phone of the speaker UT has been recorded.

B: Second Embodiment

A second embodiment of the invention is described below. In each embodiment illustrated below, elements whose operations or functions are similar to those of the first embodiment will be denoted by the same reference numerals as used in the above description and a detailed description thereof will be omitted as appropriate.

Since the conversion function $F_q(X)$ of Equation (4A) is different for each phone (i.e., each conversion function $F_q(X)$ is different), the conversion function $F_q(X)$ discontinuously changes at boundary time points of adjacent phones in the case where the voice quality converter 24 (the conversion processor 44) generates segment data DT from segment data DS composed of a plurality of consecutive phones (phone chains). Therefore, there is a possibility that characteristics (for example, frequency spectrum envelope) of voice represented by the converted segment data DT sharply change at boundary time points of phones and a synthesized sound generated using the segment data DT sounds unnatural. An object of the second embodiment is to reduce this problem.

Figure 8:
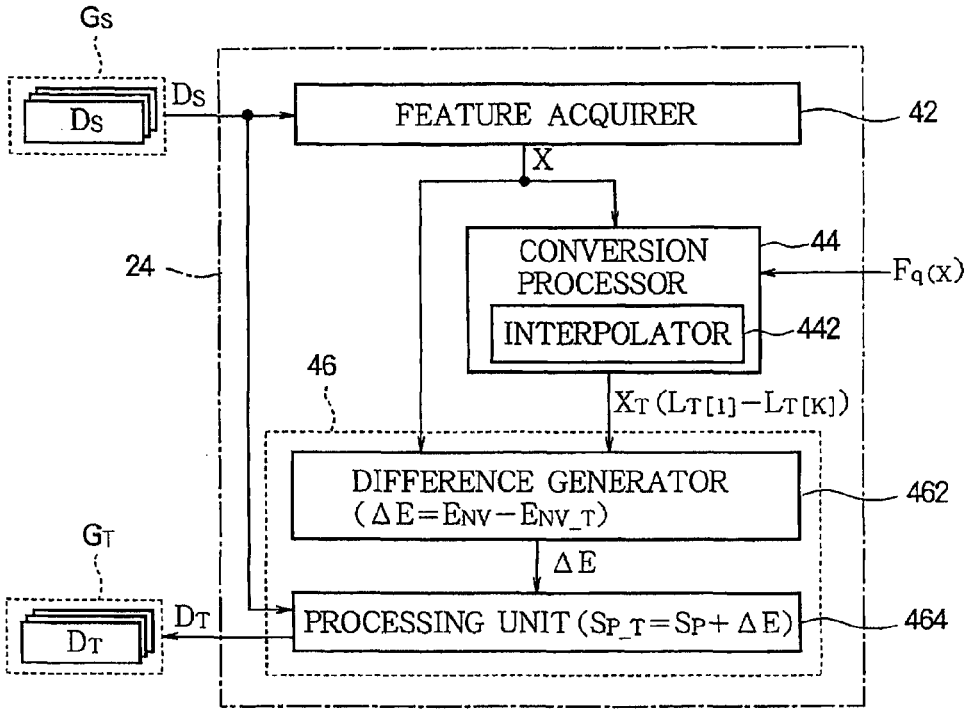
FIG. 8 is a block diagram of a voice quality converter according to a second embodiment.

FIG. 8 is a block diagram of a voice quality converter 24 of the second embodiment. As shown in FIG. 8, a conversion processor 44 of the voice quality converter 24 of the second embodiment includes an interpolator 442. The interpolator 442 interpolates a conversion function FOX) applied to feature information X of each unit interval TF when the segment data DS represents a phone chain.

Figure 9:
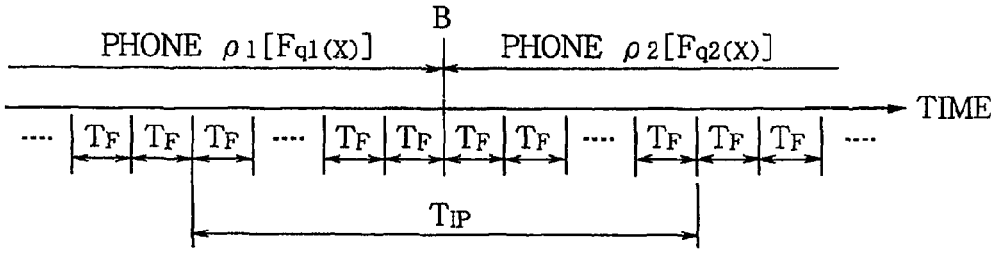
FIG. 9 illustrates an operation of an interpolator.

For example, let us consider the case where segment data DS represents a voice segment composed of a sequence of a phone ρ1 and a phone ρ2 as shown in FIG. 9. A conversion function $F_{q1}(X)$ of the phone ρ1 and a conversion function $F_{q2}(X)$ of the phone ρ2 are used to generate segment data DT. a transition period TIP including a boundary B between the phone ρ1 and the phone ρ2 is shown in FIG. 9. The transition period TIP is a duration including a number of unit intervals TF (for example, 10 unit intervals TF) immediately before the boundary B and a number of unit intervals TF (for example, 10 unit intervals TF) immediately after the boundary B.

The interpolator 442 of FIG. 8 calculates a conversion function $F_q(X)$ of each unit interval TF involved in the transition period TIP through interpolation between the conversion function $F_{q1}(X)$ of the phone ρ1 and the conversion function $F_{q2}(X)$ of the phone ρ2 such that the conversion function $F_q(X)$ applied to feature information X of each unit interval TF in the transition period TIP changes in each unit interval TF in a stepwise manner from the conversion function $F_{q1}(X)$ to the conversion function $F_{q2}(X)$ over the transition period TIP from the start to the end of the transition period TIP. While the interpolator 442 may use any interpolation method, it preferably uses, for example, linear interpolation.

The conversion processor 44 of FIG. 8 applies, to each unit interval TF outside the transition period TIP, a conversion function $F_q(X)$ corresponding to a phone of the unit interval TF, similar to the first embodiment, and applies a conversion function $F_q(X)$ interpolated by the interpolator 442 to feature information X of each unit interval TF within the transition period TIP to generate feature information XT of each unit interval TF.

The second embodiment has the same advantages as the first embodiment. In addition, the second embodiment has an advantage in that it is possible to generate a synthesized sound that sounds natural, in which characteristics (for example, envelopes) of adjacent phones are smoothly continuous, from segment data DT since the interpolator 442 interpolates the conversion function $F_q(X)$ such that the conversion function $F_q(X)$ applied to feature information X near a phone boundary B of segment data DS changes in a stepwise manner within the transition period TIP.

C: Third Embodiment

Figure 10:
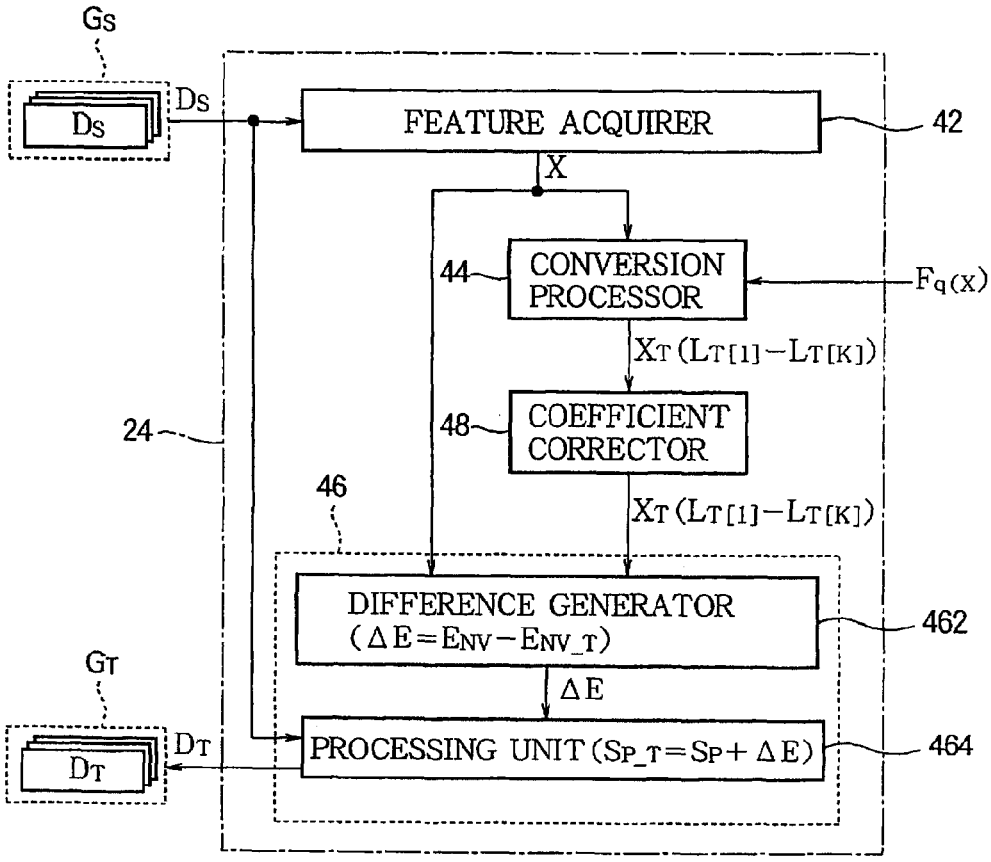
FIG. 10 is a block diagram of a voice quality converter according to a third embodiment.

FIG. 10 is a block diagram of the voice quality converter 24 according to a third embodiment. As shown in FIG. 10, the voice quality converter 24 of the third embodiment is constructed by adding a coefficient corrector 48 to the voice quality converter 24 of the first embodiment. The coefficient corrector 48 corrects coefficient values LT[1] to LT[K] of the feature information XT of each unit interval TF generated by the conversion processor 44.

Figure 11:
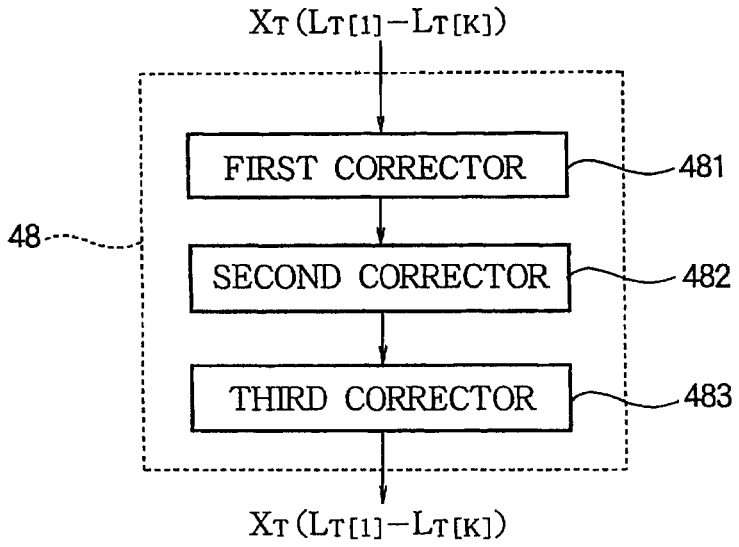
FIG. 11 is a block diagram of a coefficient corrector.

As shown in FIG. 11, the coefficient corrector 48 includes a first corrector 481, a second corrector 482, and a third corrector 483. Using the same method as in the first embodiment, a segment data generator 46 of FIG. 10 sequentially generates, for each unit interval TF, segment data DT corresponding to the feature information XT including coefficient values LT[1] to LT[K] corrected by the first corrector 481, the second corrector 482, and the third corrector 483. Details of correction of coefficient values LT[1] to LT[K] are described below.

<First Corrector 481>

The coefficient values (line spectral frequencies) LT[1] to LT[K] representing the envelope ENV_T need to be in a range R of 0 to π (0<LT[1]<LT[2] . . . <LT[K]<π). However, there is a possibility that the coefficient values LT[1] to LT[K] are outside the range R due to processing by the voice quality converter 24 (i.e., due to conversion based on the conversion function FOX)). Therefore, the first corrector 481 corrects the coefficient values LT[1] to LT[K] to values within the range R. Specifically, when the coefficient value LT[k] is less than zero (LT[k]<0), the first corrector 481 changes the coefficient value LT[k] to a coefficient value LT[k+1] that is adjacent to the coefficient value LT[k] at the positive side thereof on the frequency axis (LT[k]=LT[k+1]). On the other hand, when the coefficient value LT[k] is higher than π (LT[k]>π), the first corrector 481 changes the coefficient value LT[k] to a coefficient value LT[k−1] that is adjacent to the coefficient value LT[k] at the negative side thereof on the frequency axis (LT[k]=LT[k−1]). As a result, the corrected coefficient values LT[1] to LT[k] are distributed within the range R.

<Second Corrector 482>

When the difference ΔL (ΔL=LT[k]−LT[k−1]) between two adjacent coefficient values LT[k] and LT[k−1] is excessively small (i.e., spectral lines are excessively close to each other), there is a possibility that the envelope ENV_T has an abnormally great peak such that reproduced sound of the voice signal VSYN sounds unnatural. Therefore, the second corrector 482 increases the difference ΔL between two adjacent coefficient values LT[k] and LT[k−1] when the difference is less than a predetermined value Δmin.

Figure 12:
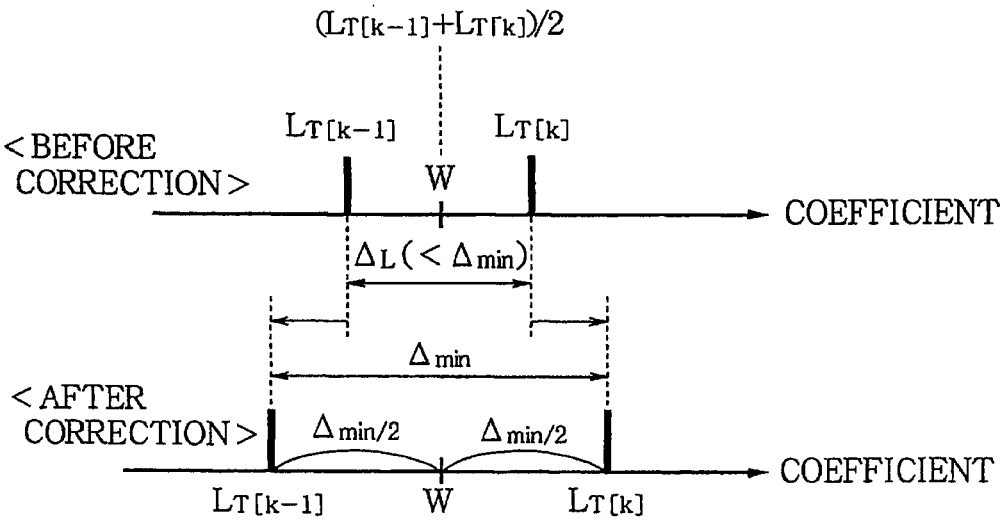
FIG. 12 illustrates an operation of a second corrector.

Specifically, when the difference ΔL between two adjacent coefficient values LT[k] and LT[k−1] is less than the predetermined value Δmin, the negative-side coefficient value LT[k−1] is set to a value obtained by subtracting one half of the predetermined value Δmin from a middle value W (=(LT[k−1]+LT[k])/2)) of the coefficient value LT[k−1] and the coefficient value [k] (LT[k−1]=W−Δmin/2) as shown in FIG. 12. On the other hand, the positive-side coefficient value LT[k] before correction is set to a value obtained by adding one half of the predetermined value Δmin to the middle value W (LT[k]=W+Δmin/2). Accordingly, the coefficient value LT[k−1] and the coefficient value LT[k] after correction by the second corrector 482 are set to values that are separated by the predetermined value Δmin with respect to the middle value W. That is, the interval between a spectral line of the coefficient value LT[k−1] and a spectral line of the coefficient value LT[k] is increased to the predetermined value Δmin.

<Third Corrector 483>

Figure 13:
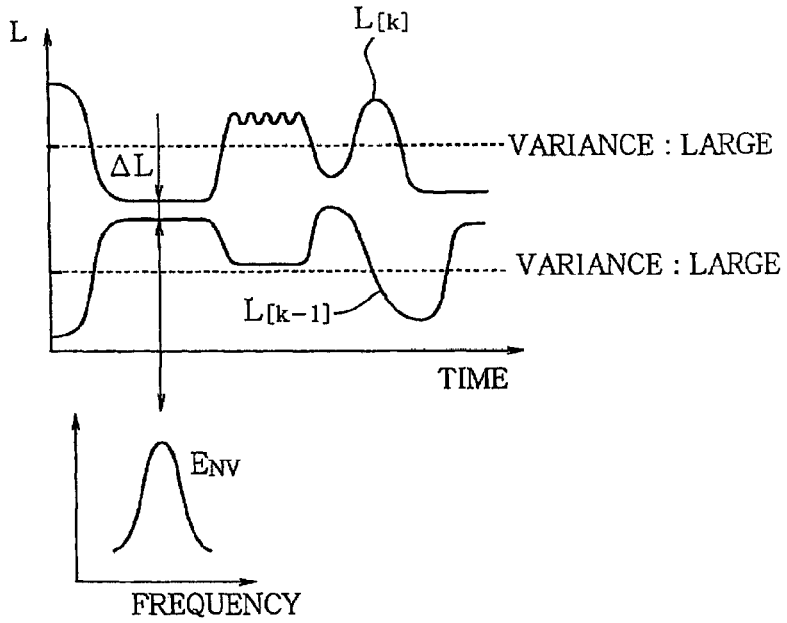
FIG. 13 illustrates a relationship between an envelope and a time series of a coefficient value of each order.

FIG. 13 illustrates a time series (trajectory) of each order k of the coefficient value L[k] before conversion by the conversion function $F_q(X)$. Since each coefficient value L[k] before conversion by the conversion function $F_q(X)$ is appropriately spread (i.e., temporally changes appropriately), a duration in which the adjacent coefficient values L[k] and L[k−1] have appropriately approached each other is present as shown in FIG. 13. Accordingly, the envelope ENV expressed by the feature information X before conversion has an appropriately high peak as shown in FIG. 13.

Figure 14:
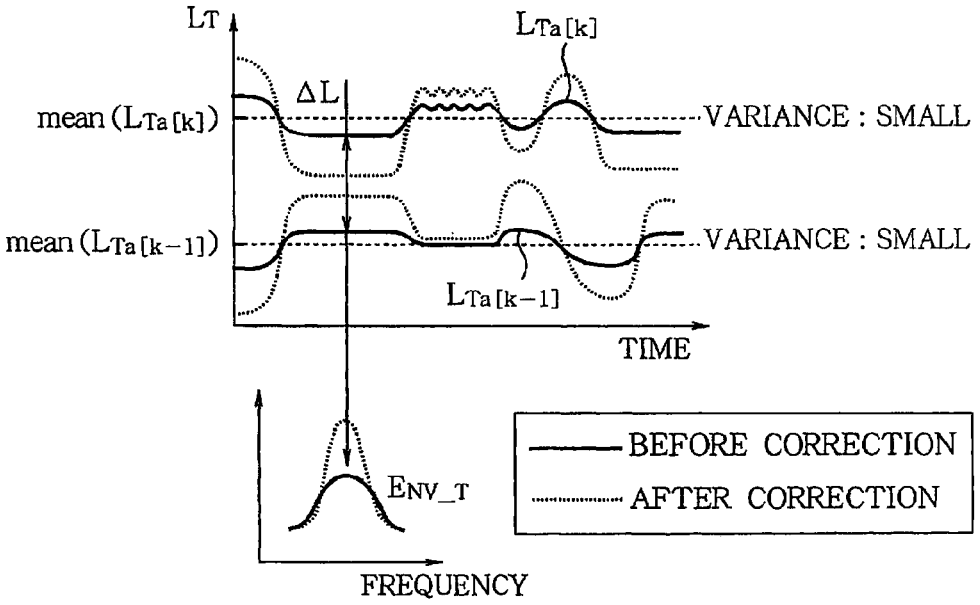
FIG. 14 illustrates an operation of a third corrector.

A solid line in FIG. 14 is a time series (trajectory) of each order k of the coefficient value LTa[k] after conversion by the conversion function $F_q(X)$. The coefficient value LTa[k] is a coefficient value LT[k] that has not been corrected by the third corrector 483. As is understood from Equation (4A), in the conversion function $F_q(X)$, the average $\mu_q^X$ is subtracted from the feature information X and the resulting value is multiplied by the square root (less than 1) of the ratio $(\Sigma_q^{YY}(\Sigma_q^{XX})^{-1})$ of the covariance $\Sigma_q^{YY}$ to the covariance $\Sigma_q^{XX}$. Due to subtraction of the average $\mu_q^X$ and multiplication by the square root of the ratio $(\Sigma_q^{YY}(\Sigma_q^{XX})$, the variance of each coefficient value LTa[k] after conversion using the conversion function $F_q(X)$ is reduced compared to that before conversion shown in FIG. 13 as shown in FIG. 14. That is, temporal change of the coefficient value LTa[k] is suppressed. Accordingly, there is a tendency that the difference ΔL between adjacent coefficient values LTa[k−1] and LTa[k] is maintained at a high value and the peak of the envelope ENV_T represented by the feature information XT is suppressed (smoothed) as shown in FIG. 14. In the case where the peak of the envelope ENV_T is suppressed in this manner, there is a possibility of reproduced sound of the voice signal VSYN sounding unclear and unnatural.

Therefore, the third corrector 483 corrects each of the coefficient values LTa[1] to LTa[K] so as to increase the variance of each order k of the coefficient value LTa[k] (i.e., to increase a dynamic range in which the coefficient value LT[k] varies with time). Specifically, the third corrector 483 calculates the corrected coefficient value LT[k] according to the following Equation (10).

$$LT[k] = (\alpha_{std} \cdot \sigma_k)\frac{LTa[k] - \text{mean}(LTa[k])}{std(LTa[k])} + \text{mean}(LTa[k]) \tag{10}$$

A symbol mean(LTa[k]) in Equation (10) denotes an average of the coefficient value LTa[k] within a predetermined period PL. While the time length of the period PL is arbitrary, it may be set to, for example, a time length of about 1 phrase of vocal music. A symbol std(LTa[k]) in Equation (10) denotes a standard deviation of each coefficient value LTa[k] within the period PL.

A symbol σk in Equation (10) denotes a standard deviation of a coefficient value L[k] of order k among the K coefficient values L[1] to L[K] that constitute feature information Y (see FIG. 3) of each unit interval TF in the voice signal VT of the speaker UT. In the procedure (shown in FIG. 3) in which the function specifier 22 generates the covariance $F_q(X)$, the standard deviation σk of each order k is calculated from the feature information Y of the voice signal VT and is then stored in the storage device 14. The third corrector 483 applies the standard deviation σk stored in the storage device 14 to the calculation of Equation (10). A symbol αstd in Equation (10) denotes a predetermined constant (normalization parameter). While the constant αstd is statistically or experimentally selected so as to generate a synthesized sound that sounds natural, the constant αstd is preferably set to, for example, a value of about 0.7.

As is understood from Equation (10), the variance of the coefficient value LTa[k] is normalized by dividing the value obtained by subtracting the average mean(LTa[k]) from the uncorrected coefficient value LTa[k] by the standard deviation std(LTa[k]), and the variance of the coefficient value LTa[k] is increased through multiplication by the constant αstd and the standard deviation σk. Specifically, the variance of the corrected coefficient value LT[k] increases compared to that of the uncorrected coefficient value as the standard deviation (variance) σk of the coefficient value L[k] of the feature information Y of the voice signal VT (each phone data item PT) increases. Addition of the average mean(LTa[k]) in Equation (10) allows the average of the corrected coefficient value LT[k] to match the average of the uncorrected coefficient value LTa[k].

As a result of the calculation described above, the variance of the time series of the corrected coefficient value LT[k] increases (i.e., the temporal change of the coefficient value LT[k] increases) compared to that of the uncorrected coefficient value LT[k] as shown by dashed lines in FIG. 14. Accordingly, the adjacent coefficient values LT[k−1] and LT[k] appropriately approach each other. That is, as shown by dashed lines in FIG. 14, peaks similar to those before correction through the conversion function $F_q(X)$ are generated as frequently as is appropriate in the envelope ENV_T represented by the feature information XT corrected by the third corrector 483 (i.e., the influence of conversion through the conversion function $F_q(X)$ is reduced). Accordingly, it is possible to synthesize a clear and natural sound.

The third embodiment achieves the same advantages as the first embodiment. In addition, in the third embodiment, since the feature information XT (i.e., coefficient values LT[1] to LT[K]) produced through conversion by the voice quality converter 24 is corrected, the influence of conversion through the conversion function $F_q(X)$ is reduced, thereby generating a natural sound. At least one of the first corrector 481, the second corrector 482, and the third corrector 483 may be omitted. The order of corrections in the coefficient corrector 48 is also arbitrary. For example, it is possible to employ a configuration in which correction of the first corrector 481 or the second corrector 482 is performed after correction of the third corrector 483 is performed.

D: Fourth Embodiment

Figure 15:
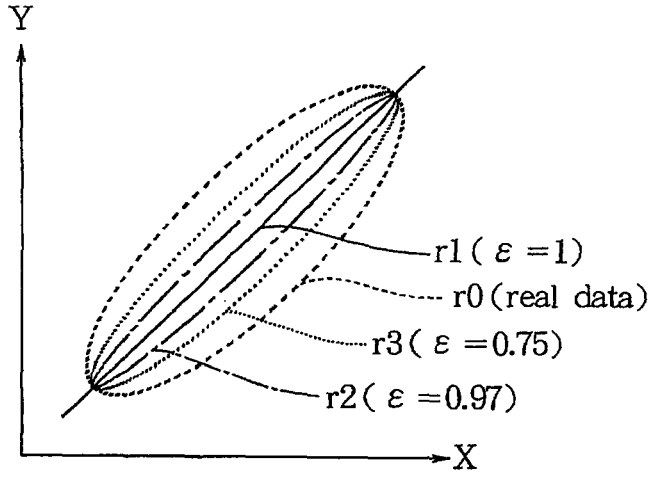
FIG. 15 is a diagram explaining an adjusting coefficient and a distribution range of the feature information in a fourth embodiment.

FIG. 15 is a scatter diagram showing correlation between the feature information X and the feature information Y of actually collected sound of a given phone with respect to one domain of the feature information. As described above in the respective embodiments, in case that the coefficient $a_q$ of Equation (9) is applied to Equation (4A), linear correlation (Distribution r1) is observed between the feature information X and the feature information Y. On the other hand, as indicated by Distribution r0, the feature information X and the feature information Y observed from actual sound distribute broadly as compared to the case where the coefficient $a_q$ of Equation (9) is applied.

Distribution zone of the feature information X and the feature information Y approaches to a circle as the norm of the coefficient $a_q$ becomes smaller. Therefore, as compared to the case of Distribution r1, it is possible to approach the correlation between the feature information X and the feature information Y to real Distribution r0 by setting the coefficient $a_q$ such as to reduce the norm. In consideration of the above tendency, in the fourth embodiment, adjusting coefficient (weight value) e for adjusting the coefficient $a_q$ is introduced as defined in the following Equation (9A). Namely, the function specifier 22 (function generator 36) of the fourth embodiment generates the conversion function $F_q(X)$ $(F_1(X)-F_Q(X))$ of each phone by computation of Equation (4A) and Equation (9A). The adjusting coefficient e is set in a range of positive value less than 1 (0<e<1).

$$a_q=\epsilon\sqrt{\Sigma_q^{YY}(\Sigma_q^{XX})^{-1}} \tag{9A}$$

The Distribution r1 obtained by calculating the coefficient $a_q$ according to Equation (9) as described in the previous embodiments is equivalent to the case where the adjusting coefficient e of the Equation (9A) is set to 1. As understood from the Distribution r2 (e=0.97) and the Distribution r3 (e=0.75) shown in FIG. 15, the distribution zone of the feature information X and the feature information Y expands as the adjusting coefficient e becomes smaller, and the distribution area approaches to a circle as the adjusting coefficient e approaches to 0. FIG. 15 indicates a tendency that auditorily natural sound can be generated in case that the adjusting coefficient e is set such that the distribution of the feature information X and the feature information Y approaches to the real Distribution r0.

Figure 16:
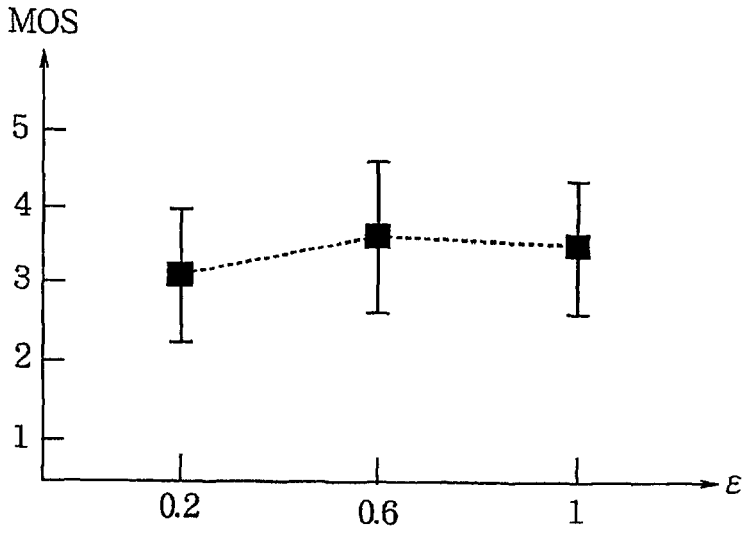
FIG. 16 is a graph showing a relation between the adjusting coefficient and MOS.

FIG. 16 is a graph showing mean values and standard deviations of MOS (Mean Opinion Score) of reproduced sound of audio signal VSYN generated for each segment data DT of the speaker UT by the Voice Synthesizer 26, where the adjusting coefficient e is varied as a parameter to different values 0.2, 0.6 and 1.0. The vertical axis of graph of FIG. 16 indicates MOS which represents an index value (1-5) of subjective evaluation of sound quality, and which means that the sound quality is higher as the index value is greater.

A certain tendency is recognized from FIG. 16 that the sound having high quality is generated when the adjusting coefficient e is set to a value around 0.6. In view of the above tendency, the adjusting coefficient e of the Equation (9A) is set to a range between 0.5 and 0.7, and is preferably set to 0.6.

The fourth embodiment also achieves the same effects as those achieved by the first embodiment. Further in the fourth embodiment, the coefficient $a_q$ is adjusted by the adjusting parameter e, hence dispersion of the coefficient value LTa[k] after conversion by the conversion function $F_q(X)$ increases (namely, variation of the numerical value along time axis increases). Therefore, there is an advantage of generating segment data DT capable of synthesizing auditorily natural sound of high quality by the same manner as the third embodiment which is described in conjunction with FIG. 14.

E: Modifications

Various modifications can be made to each of the above embodiments. The following are specific examples of such modifications. Two or more modifications freely selected from the following examples may be appropriately combined.

(1) Modification 1

The format of the segment data D (DS, DT) is diverse. For example, it is possible to employ a configuration in which the segment data D represents a frequency spectrum of voice or a configuration in which the segment data D represents feature information (X, Y, YT). Frequency analysis (S11, S12) of FIG. 3 is omitted in the configuration in which the segment data DS represents a frequency spectrum. The feature acquirer 32 or the feature acquirer 42 functions as a component for acquiring the segment data D and the procedure of FIG. 4 (frequency analysis (S11, S12), envelope specification (S13, S14), etc.) is omitted in the configuration in which the segment data DS represents feature information (X, Y, YT). A method of generating a voice signal VSYN through the voice synthesizer 26 (the synthesis processor 54) is appropriately selected according to the format of the segment data D (DS, DT).

In each of the above embodiments, the feature represented by the feature information (X, Y, XT) is not limited to a series of K coefficient values L[1] to L[K] (LT[1] to LT[K]) specifying an AR model line spectrum. For example, it is also possible to employ a configuration in which the feature information (X, Y, XT) represents another feature such as MFCC (Mel-Frequency Cepstral Coefficient) and Cepstral Coefficients.

(2) Modification 2

Although a segment group GT including a plurality of segment data items DT is previously generated before voice synthesis is performed in each of the above embodiments, it is also possible to employ a configuration in which the voice quality converter 24 sequentially generates segment data items DT in parallel with voice synthesis through the voice synthesizer 26. That is, each time a word is specified by a vocal part in score data SC, segment data DS corresponding to the word is acquired from the storage device 14 and a conversion function $F_q(X)$ is applied to the acquired segment data DS to generate segment data DT. The voice synthesizer 26 sequentially generates a voice signal VSYN from the segment data DT generated by the voice quality converter 24. In this configuration, there is an advantage in that required capacity of the storage device 14 is reduced since there is no need to store a segment group GT in the storage device 14.

(3) Modification 3

Although the voice processing device 100 including the function specifier 22, the voice quality converter 24, and the voice synthesizer 26 is illustrated in each of the embodiments, the elements of the voice processing device 100 may be individually mounted in a plurality of devices. For example, a voice processing device including a function specifier 22 and a storage device 14 that stores a segment group GS and a voice signal VT (i.e., having a configuration in which a voice quality converter 24 or a voice synthesizer 26 is omitted) may be used as a device (a conversion function generation device) that specifies a conversion function $F_q(X)$ that is used by a voice quality converter 24 of another device. In addition, a voice processing device including a voice quality converter 24 and a storage device 14 that stores a segment group GS (i.e., having a configuration in which a voice synthesizer 26 is omitted) may be used as a device (a segment data generation device) that generates a segment group GT used for voice synthesis by a voice synthesizer 26 of another device by applying a conversion function $F_q(X)$ to the segment group GS.

(4) Modification 4

Although synthesis of a singing sound is illustrated in each of the above embodiments, it is possible to apply the invention in the same manner as in each of the above embodiments when a spoken sound (for example, a conversation) other than singing sound is synthesized.

What is claimed is:

1. A voice processing device comprising:

a first distribution generation unit configured to approximate a distribution of feature information representative of a voice of a first speaker per a unit interval thereof as a mixed probability distribution which is a mixture of a plurality of first probability distributions, the plurality of first probability distributions corresponding to a plurality of different phones;

a second distribution generation unit configured to approximate a distribution of feature information representative of a voice of a second speaker per a unit interval thereof as a mixed probability distribution which is a mixture of a plurality of second probability distributions corresponding to a plurality of different phones;

a function generation unit configured to generate, for each phone, a conversion function for converting the feature information representative of the voice of the first speaker to the feature information representative of the voice of the second speaker based on respective statistics of the first probability distribution and the second probability distribution that correspond to the phone, wherein the conversion function is generated based on an auto-covariance of the first probability distribution and an auto-covariance of the second probability distribution, without using a cross-covariance between the feature information representative of the voice of the first speaker and the feature information representative of the voice of the second speaker, wherein the conversion function for a qth phone (q=1–Q) among a plurality of Q phones includes the following Expression (A) using an average $\mu_q^X$ and an auto-covariance $\Sigma_q^{XX}$ as statistics of the first probability distribution corresponding to the qth phone, an average $\mu_q^Y$ and an auto-covariance $\Sigma_q^{YY}$ of the second probability distribution corresponding to the qth phone, and feature information X representative of the voice of the first speaker:

$$\mu_q^Y+\sqrt{\Sigma_q^{YY}(\Sigma_q^{XX})^{-1}}(X-\mu_q^X \qquad \text{Expression (A), and}$$

a voice quality conversion unit configured to sequentially generate second segment data for each voice segment of the second speaker based on feature information obtained by applying a conversion function corresponding to a phone contained in the voice segment to feature information of the voice segment represented by first segment data.

2. The voice processing device according to claim 1, wherein the conversion function for a qth phone (q=1–Q) among a plurality of Q phones includes the following Expression (B) using an average $\mu_q^X$ and an auto-covariance $\Sigma_q^{XX}$ as statistics of the first probability distribution corresponding to the qth phone, an average $\mu_q^Y$ and an auto-covariance $\Sigma_q^{YY}$ of the second probability distribution corresponding to the qth phone, feature information X representative of the voice of the first speaker, and an adjusting coefficient e (0<e<1):

$$\mu_q^Y+e\sqrt{\Sigma_q^{YY}(\Sigma_q^{XX})^{-1}}(X-\mu_q^X \qquad \text{Expression (B).}$$

3. The voice processing device according to claim 1 further comprising:

a storage unit configured to store the first segment data representing voice segments of the first speaker, each voice segment comprising one or more phones.

4. The voice processing device according to claim 1, wherein, when the first segment data has a voice segment composed of a sequence of a first phone and a second phone, the voice quality conversion unit is configured to apply an interpolated conversion function to feature information of each unit interval within a transition period including a boundary between the first phone and the second phone such that the interpolated conversion function changes in a stepwise manner from a conversion function of the first phone to a conversion function of the second phone within the transition period.

5. The voice processing device according to claim 1, wherein the voice quality conversion unit comprises:

a feature acquisition unit configured to acquire feature information including a plurality of coefficient values, each representing a frequency of a line spectrum that represents, by a frequency line density of the line spectrum, a height of each peak in an envelope of a frequency domain of a voice represented by each first segment data;

a conversion processing unit configured to apply the conversion function to the feature information acquired by the feature acquisition unit;

a coefficient correction unit configured to correct each coefficient value of the feature information produced through conversion by the conversion processing unit; and a segment data generation unit configured to generate second segment data corresponding to the feature information produced through correction by the coefficient correction unit.

6. The voice processing device according to claim 5, wherein the coefficient correction unit comprises a correction unit configured to change a coefficient value outside a predetermined range to a coefficient value within the predetermined range.

7. The voice processing device according to claim 5, wherein the coefficient correction unit comprises a correction unit configured to correct each coefficient value so as to increase a difference between coefficient values corresponding to adjacent spectral lines when the difference is less than a predetermined value.

8. The voice processing device according to claim 5, wherein the coefficient correction unit comprises a correction unit configured to correct each coefficient value so as to increase variance of a time series of the coefficient value of each order.

9. The voice processing device according to claim 1, further comprising a feature acquisition unit configured to acquire, for the voice of each of the first and second speakers, feature information including a plurality of coefficient values, each representing a frequency of a line spectrum that represents, by a frequency line density of the line spectrum, a height of each peak in an envelope of a frequency domain of the voice of each of the first and second speakers.

10. The voice processing device according to claim 9, wherein the feature acquisition unit comprises:

an envelope generation unit configured to generate an envelope through interpolation between peaks of the frequency spectrum for the voice of each of the first and second speakers; and a feature specification unit configured to estimate an autoregressive model approximating the envelope and sets a plurality of coefficient values according to the autoregressive model.

11. A non-transitory computer-readable storage medium containing a program executable by a computer for performing a voice processing method comprising:

approximating a distribution of feature information representative of a voice of a first speaker per a unit interval thereof as a mixed probability distribution which is a mixture of a plurality of first probability distributions, the plurality of first probability distributions corresponding to a plurality of different phones;

approximating a distribution of feature information representative of a voice of a second speaker per a unit interval thereof as a mixed probability distribution which is a mixture of a plurality of second probability distributions corresponding to a plurality of different phones;

generating, for each phone, a conversion function for converting the feature information representative of the voice of the first speaker to the feature information representative of the voice of the second speaker based on respective statistics of the first probability distribution and the second probability distribution that correspond to the phone, wherein the conversion function is generated based on an auto-covariance of the first probability distribution and an auto-covariance of the second probability distribution, without using a cross-covariance between the feature information representative of the voice of the first speaker and the feature information representative of the voice of the second speaker, wherein the conversion function for a qth phone (q=1–Q) among a plurality of Q phones includes the following Expression (A) using an average $\mu_q^X$ and an auto-covariance $\Sigma_q^{XX}$ as statistics of the first probability distribution corresponding to the qth phone, an average $\mu_q^Y$ and an auto-covariance $\Sigma_q^{YY}$ of the second probability distribution corresponding to the qth phone, and feature information X representative of the voice of the first speaker:

$$\mu_q^Y+\sqrt{\Sigma_q^{YY}(\Sigma_q^{XX})^{-1}}(X-\mu_q^X) \quad \text{Expression (A), and}$$

generating second segment data for each voice segment of the second speaker based on feature information obtained by applying a conversion function corresponding to a phone contained in the voice segment to feature information of the voice segment represented by first segment data.

12. The non-transitory computer-readable storage medium according to claim 11, the voice processing method comprising:

applying, when the first segment data has a voice segment composed of a sequence of a first phone and a second phone, an interpolated conversion function to feature information of each unit interval within a transition period including a boundary between the first phone and the second phone such that the interpolated conversion function changes in a stepwise manner from a conversion function of the first phone to a conversion function of the second phone within the transition period.

13. The non-transitory computer-readable storage medium according to claim 11, the voice processing method comprising:

acquiring feature information including a plurality of coefficient values, each representing a frequency of a line spectrum that represents, by a frequency line density of the line spectrum, a height of each peak in an envelope of a frequency domain of a voice represented by each first segment data;

applying the conversion function to the acquired feature information;

correcting each coefficient value of the feature information produced through said applying of the conversion function; and generating second segment data corresponding to the feature information produced through said correcting of each coefficient value.

14. The non-transitory computer-readable storage medium according to claim 11, the voice processing method comprising:

acquiring, for the voice of each of the first and second speakers, feature information including a plurality of coefficient values, each representing a frequency of a line spectrum that represents, by a frequency line density of the line spectrum, a height of each peak in an envelope of a frequency domain of the voice of each of the first and second speakers.

15. A voice processing device comprising:

a non-transitory computer-readable storage medium storing a program; and a computer for executing the program for performing:

approximating a distribution of feature information representative of a voice of a first speaker per a unit interval thereof as a mixed probability distribution which is a mixture of a plurality of first probability distributions, the plurality of first probability distributions corresponding to a plurality of different phones;

approximating a distribution of feature information representative of a voice of a second speaker per a unit interval thereof as a mixed probability distribution which is a mixture of a plurality of second probability distributions corresponding to a plurality of different phones;

generating, for each phone, a conversion function for converting the feature information representative of the voice of the first speaker to the feature information representative of the voice of the second speaker based on respective statistics of the first probability distribution and the second probability distribution that correspond to the phone, wherein the conversion function is generated based on an auto-covariance of the first probability distribution and an auto-covariance of the second probability distribution, without using a cross-covariance between the feature information representative of the voice of the first speaker and the feature information representative of the voice of the second speaker, wherein the conversion function for a qth phone (q=1−Q) among a plurality of Q phones includes the following Expression (A) using an average $\mu_q^X$ and an auto-covariance $\Sigma_q^{XX}$ as statistics of the first probability distribution corresponding to the qth phone, an average $\mu_q^Y$ and an auto-covariance $\Sigma_q^{YY}$ of the second probability distribution corresponding to the qth phone, and feature information X representative of the voice of the first speaker:

$$\mu_q^Y+\sqrt{\Sigma_q^{YY}(\Sigma_q^{XX})^{-1}}(X-\mu_q^X) \quad \text{Expression (A), and}$$

generating second segment data for each voice segment of the second speaker based on feature information obtained by applying a conversion function corresponding to a phone contained in the voice segment to feature information of the voice segment represented by first segment data.

16. The voice processing device according to claim 15, the computer for executing the program for performing:

applying, when the first segment data has a voice segment composed of a sequence of a first phone and a second phone, an interpolated conversion function to feature information of each unit interval within a transition period including a boundary between the first phone and the second phone such that the interpolated conversion function changes in a stepwise manner from a conversion function of the first phone to a conversion function of the second phone within the transition period.

17. The voice processing device according to claim 15, the computer for executing the program for performing:

acquiring feature information including a plurality of coefficient values, each representing a frequency of a line spectrum that represents, by a frequency line density of the line spectrum, a height of each peak in an envelope of a frequency domain of a voice represented by each first segment data;

applying the conversion function to the acquired feature information;

correcting each coefficient value of the feature information produced through said applying of the conversion function; and generating second segment data corresponding to the feature information produced through said correcting of each coefficient value.

18. A voice processing device comprising:

a digital signal processor (DSP) for performing:

approximating a distribution of feature information representative of a voice of a first speaker per a unit interval thereof as a mixed probability distribution which is a mixture of a plurality of first probability distributions, the plurality of first probability distributions corresponding to a plurality of different phones;

approximating a distribution of feature information representative of a voice of a second speaker per a unit interval thereof as a mixed probability distribution which is a mixture of a plurality of second probability distributions corresponding to a plurality of different phones;

generating, for each phone, a conversion function for converting the feature information representative of the voice of the first speaker to the feature information representative of the voice of the second speaker based on respective statistics of the first probability distribution and the second probability distribution that correspond to the phone, wherein the conversion function is generated based on an auto-covariance of the first probability distribution and an auto-covariance of the second probability distribution, without using a cross-covariance between the feature information representative of the voice of the first speaker and the feature information representative of the voice of the second speaker, wherein the conversion function for a qth phone (q=1−Q) among a plurality of Q phones includes the following Expression (A) using an average $\mu_q^X$ and an auto-covariance $\Sigma_q^{XX}$ as statistics of the first probability distribution corresponding to the qth phone, an average $\mu_q^Y$ and an auto-covariance $\Sigma_q^{YY}$ of the second probability distribution corresponding to the qth phone, and feature information X representative of the voice of the first speaker:

$$\mu_q^Y+\sqrt{\Sigma_q^{YY}(\Sigma_q^{XX})^{-1}}(X-\mu_q^X) \quad \text{Expression (A), and}$$

generating second segment data for each voice segment of the second speaker based on feature information obtained by applying a conversion function corresponding to a phone contained in the voice segment to feature information of the voice segment represented by first segment data.

19. The voice processing device according to claim 18, the DSP for performing:

applying, when the first segment data has a voice segment composed of a sequence of a first phone and a second phone, an interpolated conversion function to feature information of each unit interval within a transition period including a boundary between the first phone and the second phone such that the interpolated conversion function changes in a stepwise manner from a conversion function of the first phone to a conversion function of the second phone within the transition period.

20. The voice processing device according to claim 18, the DSP for performing:

acquiring feature information including a plurality of coefficient values, each representing a frequency of a line spectrum that represents, by a frequency line density of the line spectrum, a height of each peak in an envelope of a frequency domain of a voice represented by each first segment data;

applying the conversion function to the acquired feature information;

correcting each coefficient value of the feature information produced through said applying of the conversion function; and generating second segment data corresponding to the feature information produced through said correcting of each coefficient value.

* * * * *